US008777825B1

(12) United States Patent
Kling

(10) Patent No.: US 8,777,825 B1
(45) Date of Patent: Jul. 15, 2014

(54) METHODS FOR DESIGNING BOXES AND OTHER TYPES OF CONTAINERS

(76) Inventor: Daniel Kling, New Hope, PA (US)

( * ) Notice: Subject to any disclaimer, the term of this patent is extended or adjusted under 35 U.S.C. 154(b) by 42 days.

(21) Appl. No.: 13/272,174

(22) Filed: Oct. 12, 2011

Related U.S. Application Data

(60) Provisional application No. 61/392,104, filed on Oct. 12, 2010.

(51) Int. Cl.
*B31B 3/00* (2006.01)

(52) U.S. Cl.
USPC ..... 493/162

(58) Field of Classification Search
USPC ..... 493/162, 152, 157, 243, 356, 405
See application file for complete search history.

(56) References Cited

U.S. PATENT DOCUMENTS

| | | | | |
|---|---|---|---|---|
| 3,302,321 | A * | 2/1967 | Walker | 446/488 |
| 3,698,879 | A | 10/1972 | Lucien | |
| 3,992,152 | A | 11/1976 | Okinaka et al. | |
| 4,001,964 | A * | 1/1977 | Hooker | 446/488 |
| 4,472,473 | A | 9/1984 | Davis et al. | |
| 4,518,544 | A | 5/1985 | Carter et al. | |
| 5,008,140 | A | 4/1991 | Schmertz | |
| 5,028,474 | A | 7/1991 | Czaplicki | |
| 5,049,123 | A | 9/1991 | Breton et al. | |
| 5,090,672 | A | 2/1992 | Ballestrazzi et al. | |
| 5,134,013 | A | 7/1992 | Parker | |
| 5,179,770 | A | 1/1993 | Block et al. | |
| 5,234,727 | A | 8/1993 | Hoberman | |
| 5,344,379 | A | 9/1994 | Garrone | |
| 5,393,579 | A | 2/1995 | Witte | |
| 5,484,378 | A | 1/1996 | Braithwaite | |
| 5,694,803 | A | 12/1997 | Ervin et al. | |
| 5,712,020 | A | 1/1998 | Parker | |
| 5,723,201 | A | 3/1998 | Czetto, Jr. | |
| 5,894,044 | A | 4/1999 | Norcom et al. | |
| 5,899,842 | A | 5/1999 | Di Pilla | |
| 5,937,519 | A | 8/1999 | Strand | |
| 5,980,444 | A | 11/1999 | Dickhoff | |
| 6,005,216 | A | 12/1999 | Rethwish et al. | |
| 6,185,476 | B1 | 2/2001 | Sakai | |
| 6,256,595 | B1 | 7/2001 | Schwalb et al. | |
| 6,358,191 | B1 * | 3/2002 | Greever | 493/34 |
| 6,640,605 | B2 | 11/2003 | Gitlin et al. | |
| 6,935,997 | B2 | 8/2005 | Kling | |
| 2008/0020188 | A1 * | 1/2008 | Gale | 428/174 |
| 2010/0006210 | A1 | 1/2010 | Kling | |

FOREIGN PATENT DOCUMENTS

| | | | |
|---|---|---|---|
| WO | WO98/06517 | A1 | 2/1998 |

OTHER PUBLICATIONS

Office Action Issued on May 12, 2008 for U.S. Appl. No. 11/174,800.
Office Action issued on Nov. 29, 2004 for U.S. Appl. No. 08/952,057.

* cited by examiner

*Primary Examiner* — Hemant M Desai
(74) *Attorney, Agent, or Firm* — Fox Rothschild LLP

(57) ABSTRACT

Methods for designing and manufacturing containers comprise determining a desired overall column data for the container; adapting the column data to have overlapping ends; selecting desired row data; selecting a desired perimeter geometry for a lid and floor of the container; adapting the row data, relative to column data, to yield the desired lid and floor perimeter geometries; and generating a folded geometry for the container.

3 Claims, 26 Drawing Sheets

METHODS FOR DESIGNING BOXES AND OTHER TYPES OF CONTAINERS

CROSS-REFERENCE TO RELATED APPLICATIONS

This application claims the benefit under 35 U.S.C. 119(e) of U.S. Provisional Application No. 61/392,104, the contents of which is incorporated by reference herein in its entirety.

BACKGROUND

1. Statement of the Technical Field

The inventive concepts relate to the design and manufacture of boxes and other types of containers, such as but not limited to multifaceted and fluted containers.

2. Description of Related Art

In U.S. Pat. No. 6,935,997, hereinafter referred to as "the '997 patent," a method for designing folded sheet structures is described where the corresponding flat unfolded sheet may have a creasing pattern that forms a tessellation on the sheet. The term tessellation refers to a mosaic pattern or other division of a sheet into polygonal or curved regions, or in some cases may refer more specifically to the edges and vertices between the regions in such a division.

Designing folding patterns that have multiple vertices located away from the boundary of a sheet can be difficult. A sheet with one such interior vertex may be produced by conventional methods by having fold creases emanating as rays from the vertex in alternate up-fold/down-fold convexity to yield a coffee-filter like structure. In both the folded and unfolded form the total angle of material surrounding the interior vertex is 360 degrees. To design folding tessellations that have multiple interior vertices is more difficult. Each vertex in the folded three-dimensional form must have emanating fold edges in both convexities, the angles surrounding the vertices must total 360 degrees, and the lengths of the edges between the vertices must be selected to agree trigonometrically with the pleat angles belonging to each of the vertices. In the '997 patent a family of methods for designing folding tessellations is given.

In corrugated materials the corrugations give added bending moment that resists bending across the flutes. This is seen in many materials, including corrugated cardboard, corrugated roofs, and corrugated pipe. In these cases the material has added strength due to the fluted pattern. For generally round shapes, forming the corrugations in the circumferential direction requires the sheet material to be deformed due to the difference in length between the inner and outer radius. This is seen in corrugated pipe, where the sheet material must have enough plasticity to enable the in-plane deformation of the fluting process. For circumferential flutes, as the depth of the flutes increases the required deformation also increases. For paper and other materials with nearly no plasticity, this means that the additional strength resulting from the presence of flutes is not available when a conventional circumferential corrugation methodology is used.

SUMMARY

Methods for designing containers and boxes from foldable sheets produce advanced three-dimensional structures with improved characteristics. This includes boxes for consumer items, containers for industrial products, shipping packages, display packages and other applications. The method may be described by applying and adapting the methods disclosed in the '997 patent, and in U.S. patent application Ser. No. 12/233,524, hereinafter referred to as "the '524 application." The contents of the '997 patent and the '524 application are incorporated by reference herein in their respective entireties.

Methods are disclosed herein for providing containers and boxes with multifaceted and/or fluted side walls. The boxes, including their floors and lids, may be easily assembled from a single die-cut pattern. In other embodiments the sidewalls of the box may be folded from a single sheet of material, with the floor and lid attached separately.

The multifaceted or fluted side walls may be designed for improved crush resistance, improved vibration absorption, improved hand gripping, and improved visibility and recognition. In some applications, crush resistance is of primary importance to protect the goods within the box, and circumferentially fluted boxes generally have relatively high crush resistance. For delicate bottles and other goods the flute depth provides an energy absorbing zone between the goods and an impact source.

In the same or other embodiments the multifaceted surface may be designed for its properties as an ideal gripping surface, with undulations naturally conforming to a finger pattern so that the box is easily handled without dropping and with much advantage over existing smooth-walled boxes. In the same or other embodiments the multifaceted surface may be designed so that it is easily recognized and distinguishable from other boxes. This feature can result in advantages such as the ability to readily identify boxes containing hazardous materials, or in providing brand recognition in retail displays. In other embodiments the side walls may be designed for a combination of the above advantages, including a container with improved crush resistance, improved gripping and improved recognition. The multifaceted surface can also be designed so that the boxes can pack efficiently.

Plastics can be formed into containers with complex surface geometry. Similarly, paper-mâché and various multipiece cardboard assembly techniques can be used to construct boxes with fluted side-walls. However these processes do not provide an inexpensive manufacturing process that applies broadly to sheet materials. Sheet materials may be purchased efficiently on rolls. The folding of sheet materials is a very efficient construction technique. Conventional folding techniques do not provide a methodology for designing box constructions with folding patterns having multiple interior vertices. The application of the inventive concepts disclosed herein can potentially extend the economic benefits of using folding sheet materials by providing methods for producing complex box and container geometries with diversely tailored structural advantages.

The inventive concepts disclosed herein enable boxes and other containers to be given circumferential flutes by using advanced folding patterns that require no in-plane deformation of the material. The patterns may have the box floors and lids incorporated into a one-piece folding pattern. Multiple floor and lid systems are available using single or multiple piece construction, including removable lids, integrated or attached lids with holes therein for dispensing items, and lids with convex or concave geometry.

BRIEF DESCRIPTION OF THE DRAWINGS

Embodiments will be described with reference to the following drawing figures, in which like numerals represent like items throughout the figures and in which.

Figure 4:
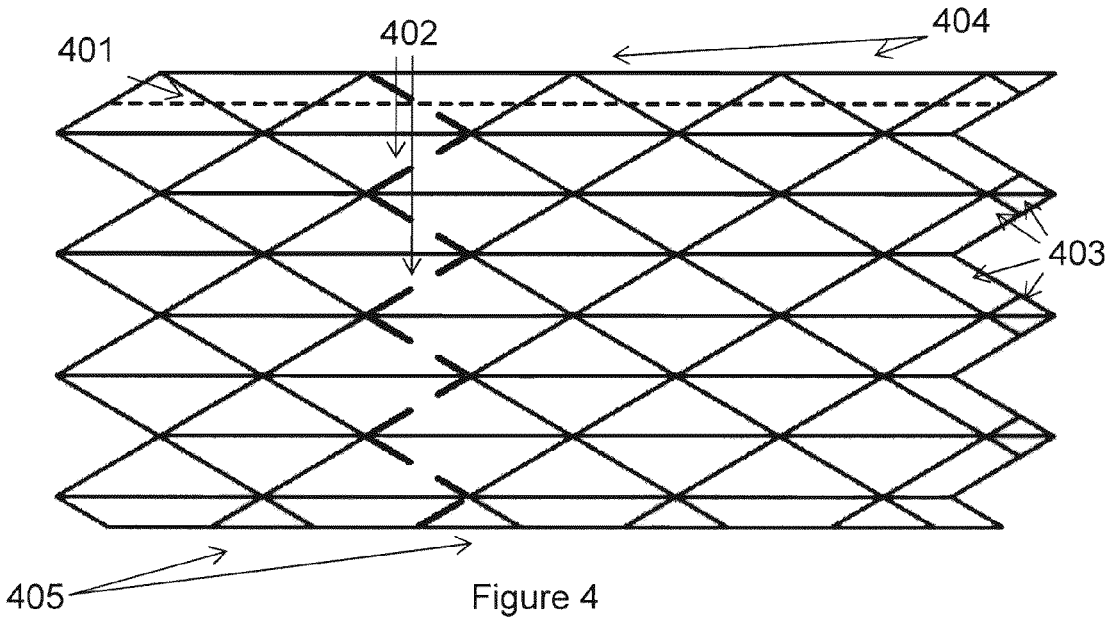
FIG. 4 is a top view of a sheet of foldable material having a tessellation pattern that produces a closed octagonal tube in accordance with the inventive methods disclosed herein. A row of polygons (403) shown as extending generally in the vertical direction of the figure are glue tabs. By adapting the Column Strip Map Method of '997 patent, this tessellation may be produced by applying the CSM of FIG. 1 and FIG. 2 to the RCS of FIG. 3. To do this, the RCS of FIG. 3 can be positioned vertically over FIG. 2, with the row axis (301) and the plane of FIG. 3 being perpendicular to lower edge (101). The row axis (301) should lie directly over a midpoint between the two dashed edges of FIG. 2. In this way the vertices of the row axis (301) with non-zero amplitude will lie over the dashed edges of FIG. 2.

The tessellation pattern depicted in FIG. 4 can also be generated by adapting the Wave Tessellation Method disclosed in the '997 patent. The triangle wave (402) shown in broken bold lines in FIG. 4 can be used for the Row Edge Tessellation (RET) data. The dashed line (401) can be used for the Column Edge Tessellation (CET) data. The intersection points of the line (401) with the tessellation are vertices dividing the line (401) into segments. By translating the RET (402) to each of these vertices, and alternately reversing the sign of its amplitude, the diagonal lines of the tessellation are generated. In an alternate case, where the length of the segments of the CET were longer or the amplitude of the RET was less, the multiple copies of the translated RET would not meet and trapezoids would be produced instead of triangles in the tessellation.

Figure 5:
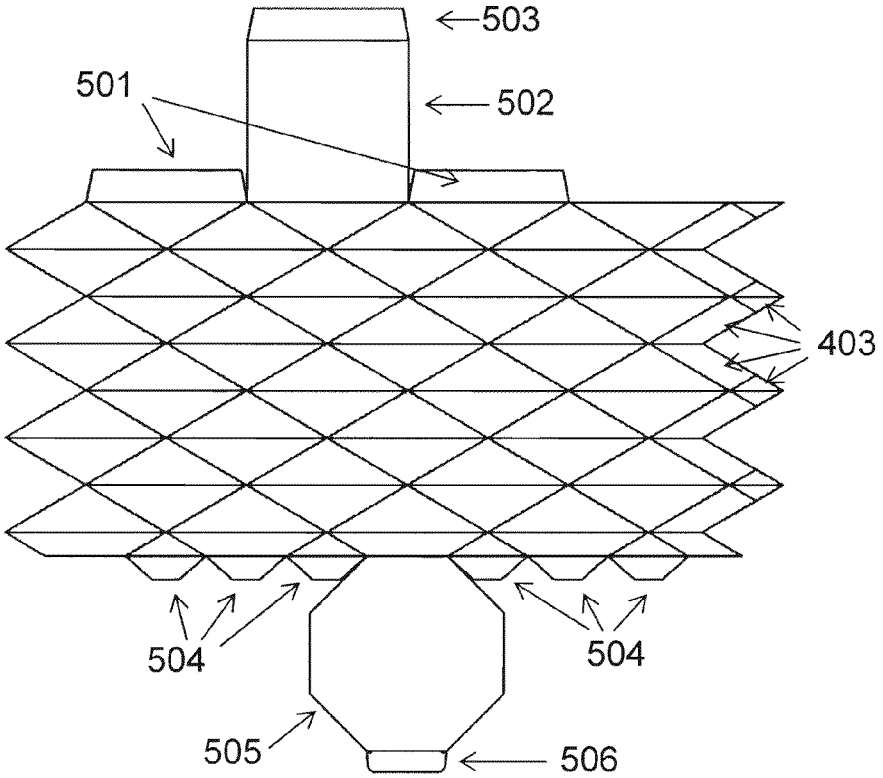

FIG. 5 is a top view of a sheet having the tessellation pattern of FIG. 4, further adapted and enhanced with a folding lid (502) and floor (505). The floor (505) is a regular octagon corresponding to the floor perimeter (405) of equal length segments and the symmetry of FIG. 1. Alternative initial vertices of (302) of non-zero amplitude, and that lie lower than midway between the dashed edges of FIG. 2 may yield non-regular octagons or a square floor perimeter.

Figure 6:
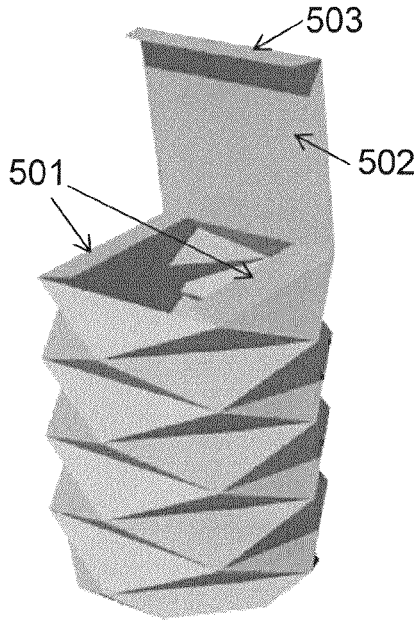

FIG. 6 is a perspective view of a three-dimensional folded and glued box produced from the tessellation pattern of FIG. 5.

Figure 7A:
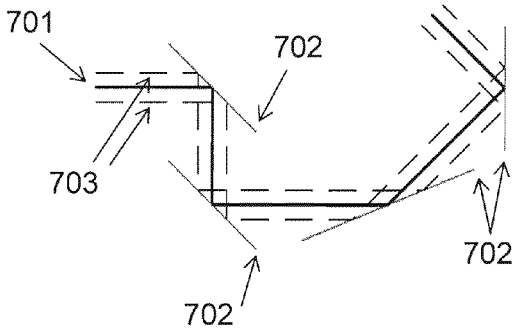
Figure 7B:
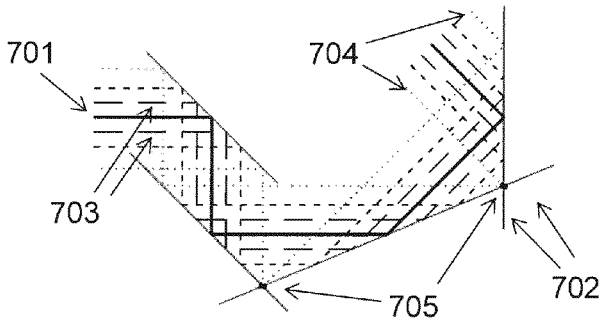

FIG. 7*a* and FIG. 7*b* show a procedure for widening Column Cross Section (CCS) data into a folded CSM. The solid line (701) is the CCS selected in this example. The lines (702) are reflection lines for the CCS, and are perpendicular to the bisecting angle of the CCS vertices. The long dashed lines (703) are offset piecewise-linear curves from the line (701), and are reflected by the (702). The offset distance may be increased by extending the length of the line segments (702) as may be seen comparing FIG. 7*a* to FIG. 7*b*. The maximal offset curves exhibiting comparable reflection sequence is determined by the points (705) where the reflection lines (702) intersect.

Figure 8:
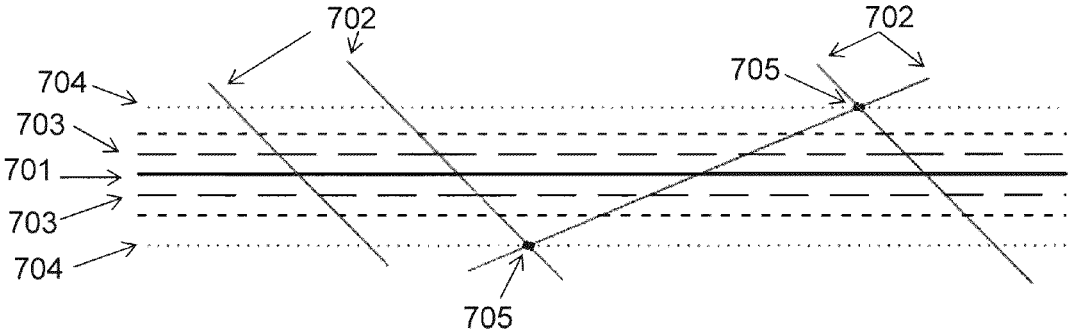

FIG. 8 depicts the unfolded CSM corresponding to FIG. 7*b*. The lines (704) form the edges of the strip. The polygons defined by the lines (702) and (704) define the polygons of the unfolded CSM, with the lines (702) indicating the fold locations. The CCS of FIG. 7*a* unfolds to the solid line (701) in FIG. 8.

Figure 9:
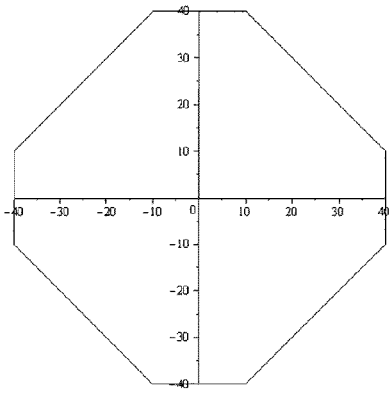

FIG. 9 is a CCS having an octagonal shape with two distinct edge lengths, which will impact the box pattern symmetry.

Figure 10:
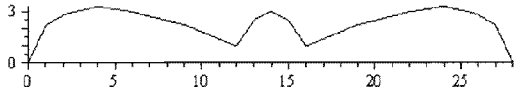

FIG. 10 is an RCS illustrating the possible use of curved geometry. This will be used with the CCS of FIG. 9 to generate a box pattern with curved flutes.

Figure 11:
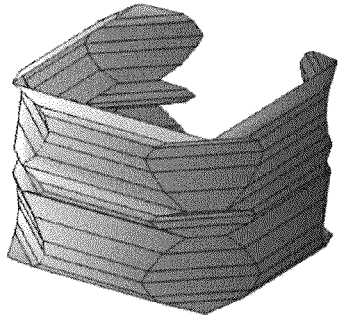
Figure 12:
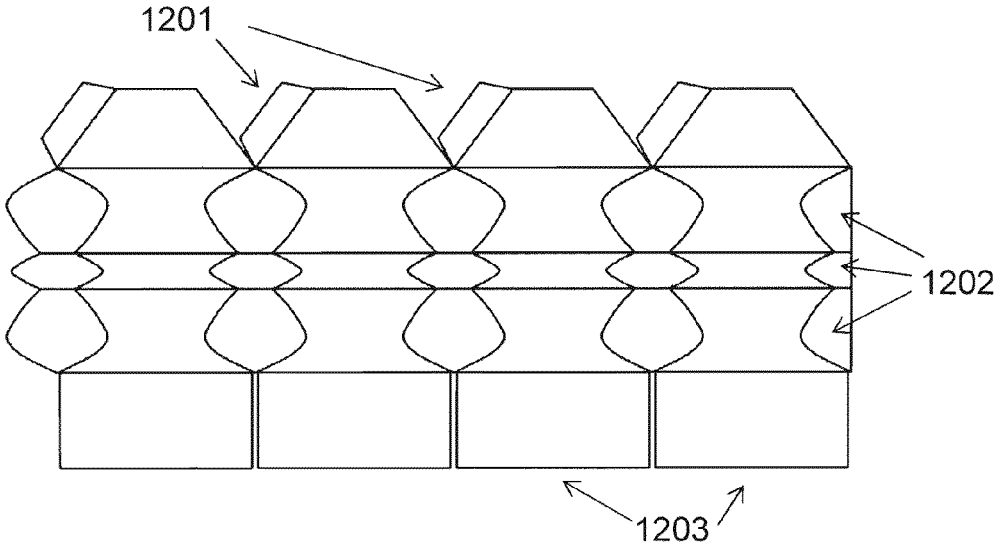

FIG. 11 is a top perspective view of a box having the folding pattern generated by the CCS of FIG. 9 and the RCS of FIG. 10. In this illustration the back wall and glue flaps are both missing. The image shows the effects of not adapting the CCS correctly before applying the Two Cross-Section Method described in the '997 patent. In FIG. 11 the octagon from FIG. 9 was augmented with only one overlapping edge. FIG. 12 shows the tessellation pattern produced with three overlapping edges in the CCS, cropped to yield smaller glue tabs, and then further adapted with floor and lid components.

FIG. 12 is a top view of a piece foldable material with a tessellation pattern for producing a box with curved fluted side walls, four-flap floor, and lid with square access hole. The tessellation pattern was generated by adapting the CCS of FIG. 9 with three overlapping edges, applying the Two Cross-Section Method with the RCS of FIG. 10, cropping the overlapping polygons in the resulting folding pattern to yield smaller glue tabs, and then further adapting the tessellation with floor (1203) and lid (1201) components.

Figure 13:
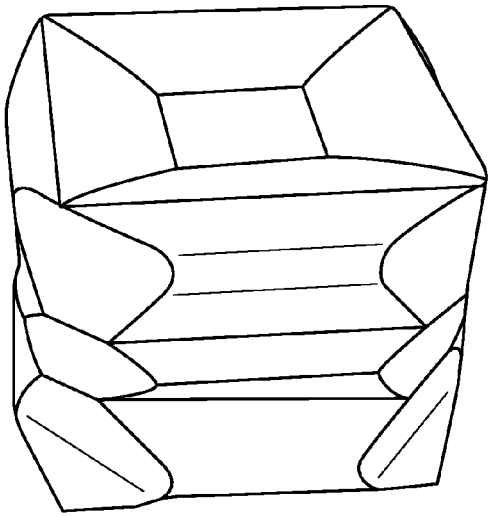

FIG. 13 is top perspective view of a folded box produced from the folding pattern in FIG. 12. The box lid has a downward slope towards its center square hole. The side walls are folded to have curved flutes.

Figure 14:
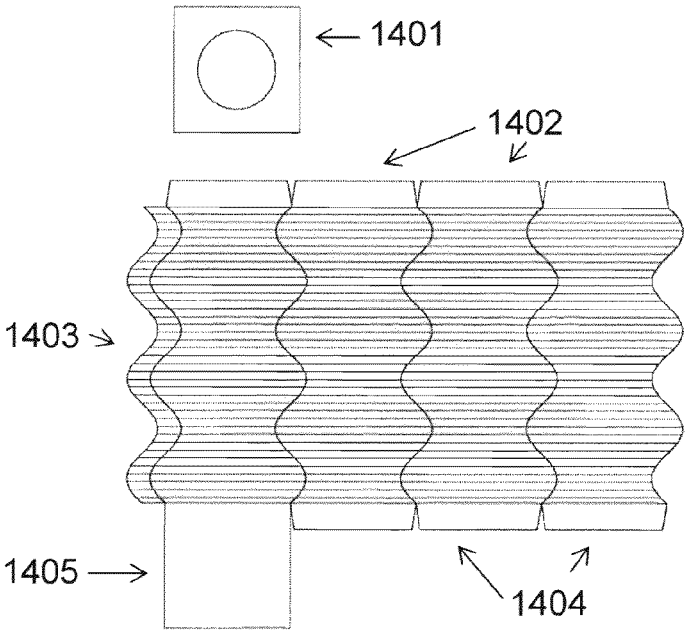
Figure 17:
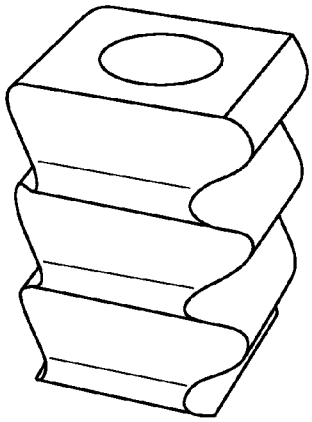

FIG. 14 is a top view of a piece foldable material with a tessellation pattern for folding a box with curved fluted sides, glued floor and round access hole in a glued lid. The cylinder that forms the box is connected closed with a glue area (1403). The horizontal lines connecting the sine-wave type curves in the figure represent the parallel lines on the curving flutes, as seen in FIG. 17. A lid (1401) of the box is cut in a separate piece from the rest of the folding pattern, and then glued on tabs (1402). A floor (1405) of the box is folded and glued to tabs (1404).

Figure 15:
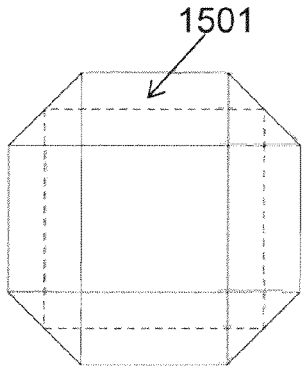
Figure 16:
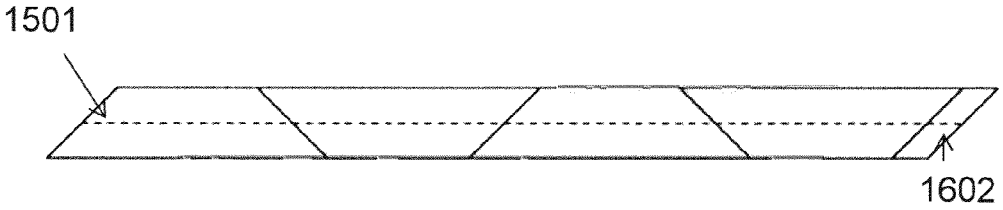

FIG. 15 depicts a folded CSM. The dotted line (1501) is a CCS that extends to the CSM. By adapting this column data to have glue tabs the unfolded strip shown in FIG. 16 is produced. By properly augmenting line (1501) with overlapping edges and applying the Two-Cross Section Method with a sine-wave type RCS, the side wall tessellation of FIG. 14 can be produced.

FIG. 16 shows an unfolded CSM used to generate the side wall tessellation of FIG. 14. By selecting a sine-wave type RCS and positioning its row axis over line (1501), applying the Strip Map method, and back calculating the unfolded tessellation, the side walls of FIG. 14 were generated. The augmentation (1602) can be seen by translating the first polygon and duplicating it adjacent to the last polygon, then cropping it back parallel to the initial terminal fold edge. By including the augmentation (1602) in the CSM, the glue area (1403) is generated and will fit to the contours of the mating cylinder face as the cylinder is closed.

FIG. 17 is a top perspective view of a box folded from the piece of foldable material depicted in FIG. 14. The circular hole represents one of many lid geometries including lids with multi-piece and/or three-dimensional structures.

Figure 3:
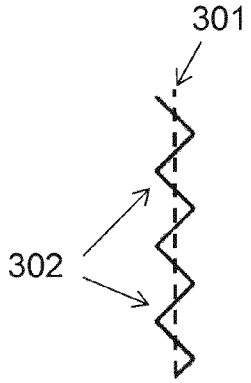
FIG. 3 depicts a Row Cross Section (RCS) of the box referenced in FIGS. 1 and 2, showing a row axis (301) and curve data (302) of the RCS. The first vertex of the curve data (302) lies on the row axis and has an amplitude of zero. The remaining vertices alternate between negative amplitudes and positive amplitudes. The absolute value of the amplitudes of these non-initial vertices are equal for the RCS as shown.
Figure 18:
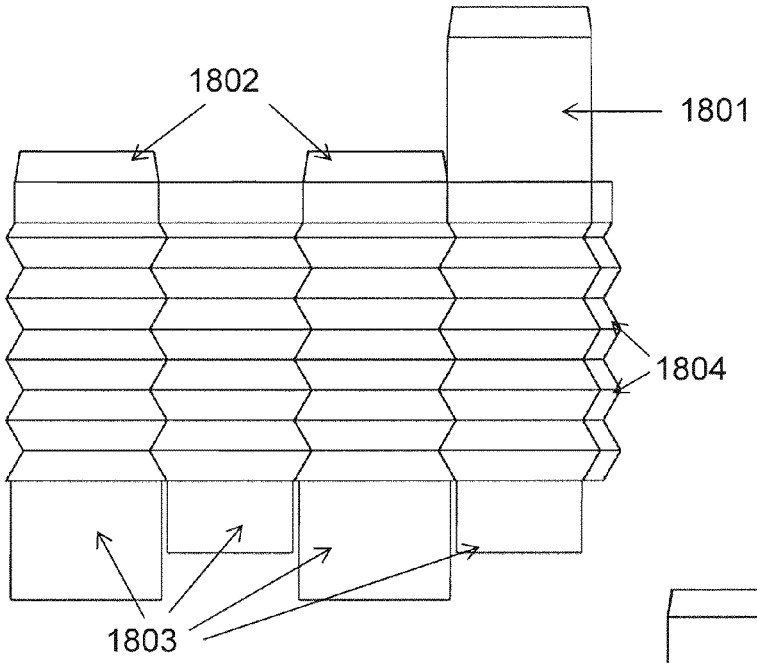

FIG. 18 is a top view of a piece of foldable material having a folding pattern for a box with fluted side walls. The tessellation for the side walls can be generated with the CSM of FIG. 16 and a RCS of the triangle wave type seen in FIG. 3. The glue areas (1804) when folded will conform to the mating cylinder edge, and can be generated using the augmentation (1602). The tabs (1803) form a three layer floor that may be glued, taped or otherwise secured. Tabs (1802) fold down to form shoulders. The lid (1801) folds down to rest on the shoulders. The lid has an additional tab, furthest from the body of the pattern, that folds to protrude through the plane of the lid perimeter and tuck into the box to hold the lid closed.

Figure 19:
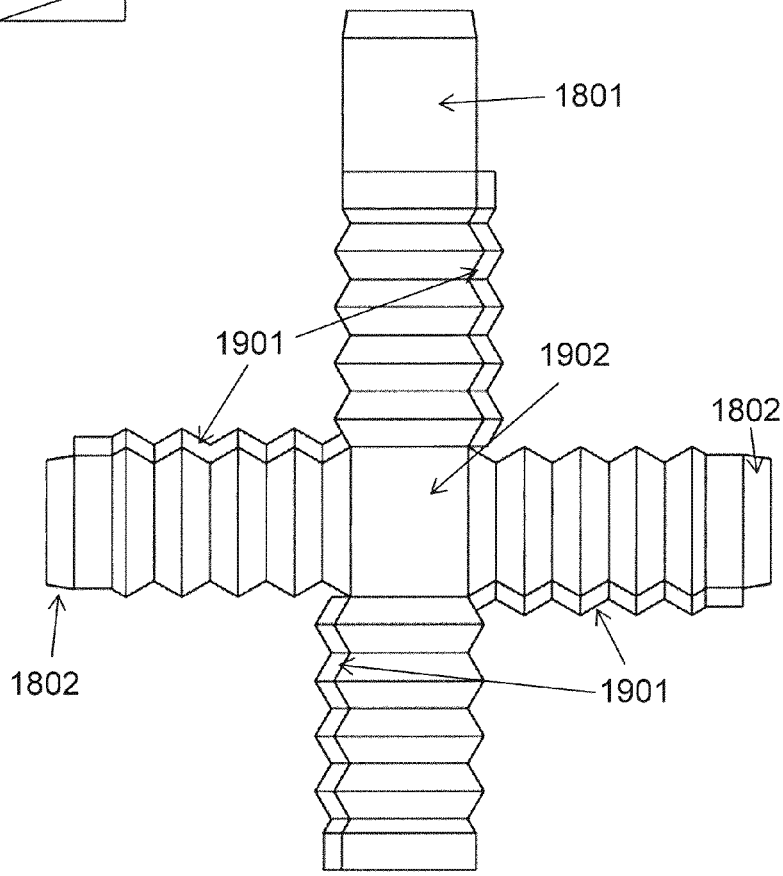

FIG. 19 is a top view of another piece of foldable material having a folding pattern for a box with fluted side walls. The tessellation pattern may be constructed from FIG. 18 by introducing multiple seams between the side walls of the box and having one floor piece connected to the side walls with no seams. To do this the rows of polygons in FIG. 18 may be separated along the row edge chains RED and then positioned radially out from their connecting edge on the floor perimeter. The glue tabs (1901) enable the wall seams to be attached together to produce the box. The glue tabs can be designed by repeating the folding pattern found on the neighboring facets in the three-dimensional design, and then trimming them to desired size.

Figure 20:
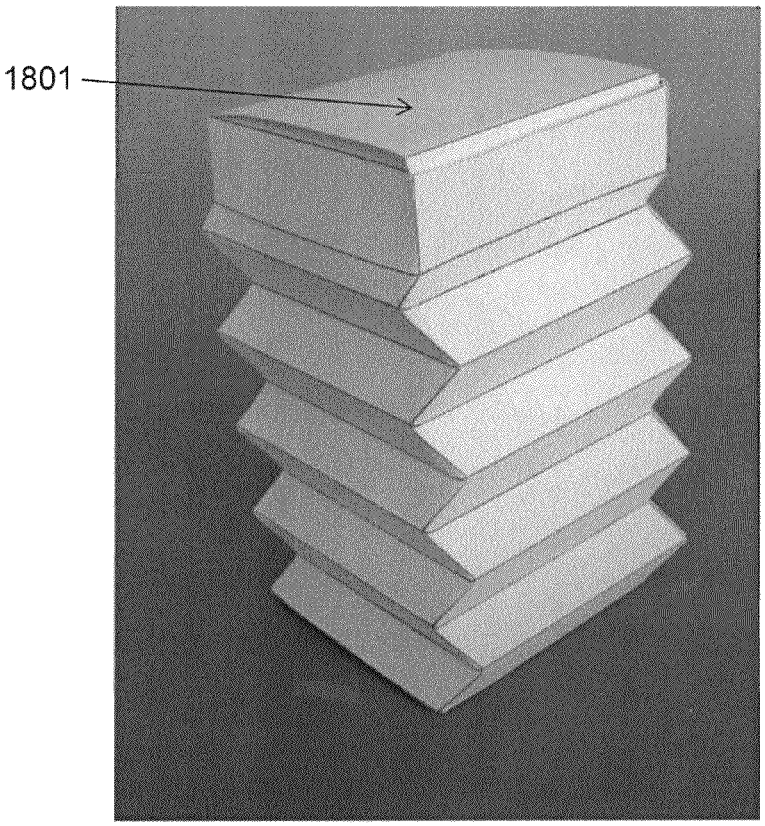

FIG. 20 is a top perspective view of a box constructed with the tessellation pattern in FIG. 18. The box cold also be produced by folding the tessellation pattern in FIG. 19.

Figure 21:
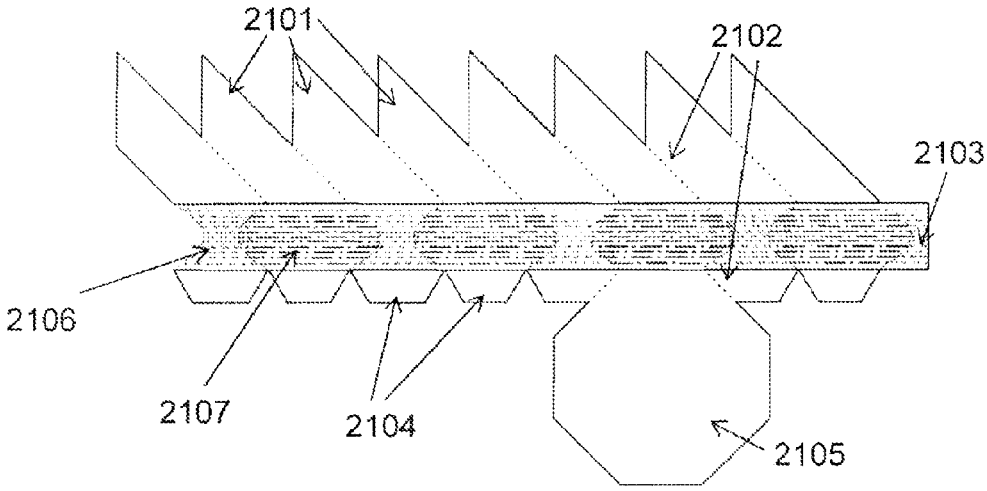

FIG. 21 is a top view of a piece of foldable material having a folding pattern for a box with fluted side walls. The dotted lines (2102) are to be cut before folding. An octagonal base (2105) is attached to glue tabs (2104). The region (2103) is the gluing area for overlapping and joining the cylindrical box closed. The lightly dashed lines (2106) become convexly curved areas of the box wall in the folded pattern. The dot-dashed lines (2107) become concavely curved areas of the box wall in the folded pattern.

Figure 22:
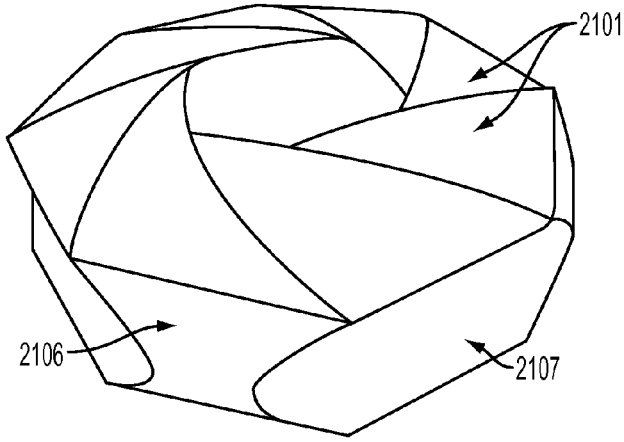

FIG. 22 is a top perspective view of a box constructed with the tessellation pattern in FIG. 21. Leaves (2101) of the lid are woven and can be designed to produce a three-dimensional lid.

Figure 23:
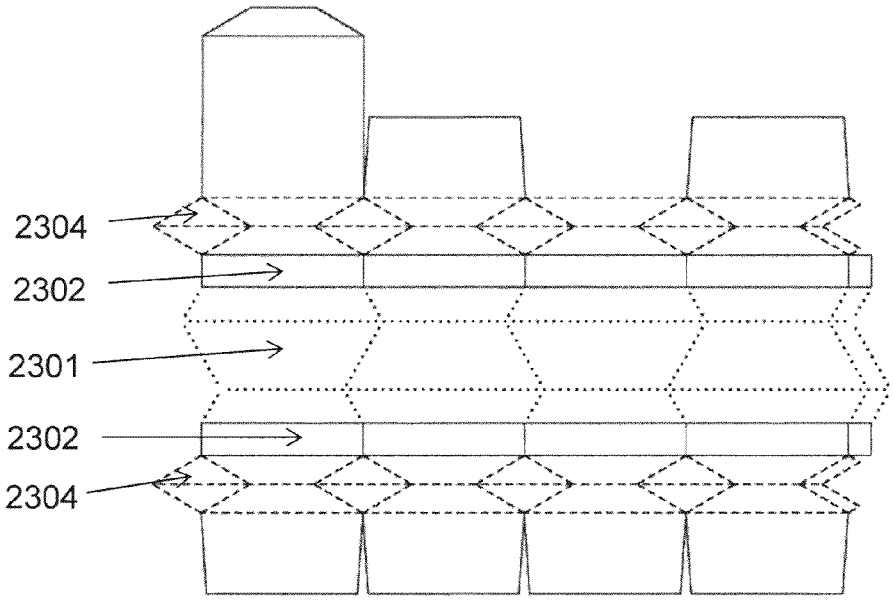

FIG. 23 is a top view of another piece of foldable material having a folding pattern for a box with fluted side walls. The pattern is a composite of multiple patterns generated by two distinct CCS's. The polygons in the dashed-line regions (2304) can be generated using the CCS of FIG. 9. The polygons in the solid-line regions (2302) and dotted-line region (2301) can be generated using the CCS of design type (1501). Both CCS should have overlap to accommodate the enclosing cylinder and glue tab regions. To produce the polygons in (2304) and (2301) the two Cross-Section Method may be applied with these CCS and the RCS from waves of type (302). To produce the polygons in (2302) the Two Cross-Section Method may be applied with either of these CCS and the RCS a constant amplitude segment. In each application with corresponding row and column data the positioning of the RCS axis relative to the CCS must be coordinated to produce mating profiles.

Figure 24:
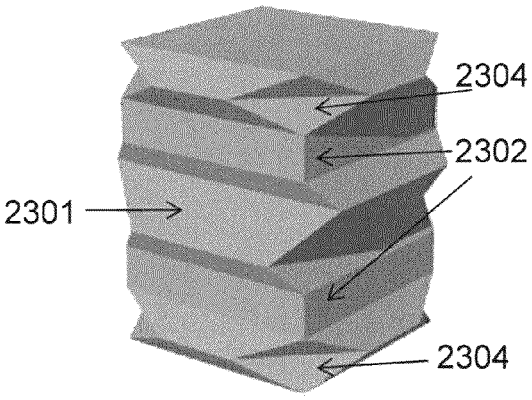

FIG. 24 is a top perspective view of the folded fluted box corresponding to the tessellation pattern in FIG. 23. Polygon regions (2302) and (2301) are also seen on trapezoidal and rectangular polygons of FIG. 20. Since the upper and lower boundaries of the (2301), (2302), and (2304) regions of FIG. 24 are all the same shape polygon, the individual pieces may be designed using various row and column data and then stacked and joined together.

Figure 25:
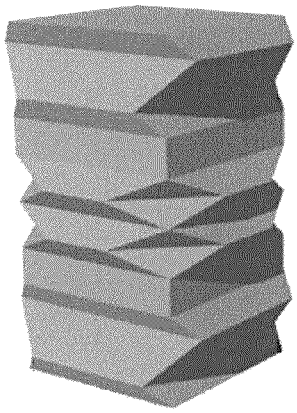

FIG. 25 is a top perspective view of a folded fluted box corresponding to an alternative stacking of the design regions of FIG. 24. The diamond corner layer (2304) of FIG. 24 occurs in the midsection of FIG. 25, the rectangular layers flank the midsection, a top and bottom sections are copies of (2301).

Figure 26:
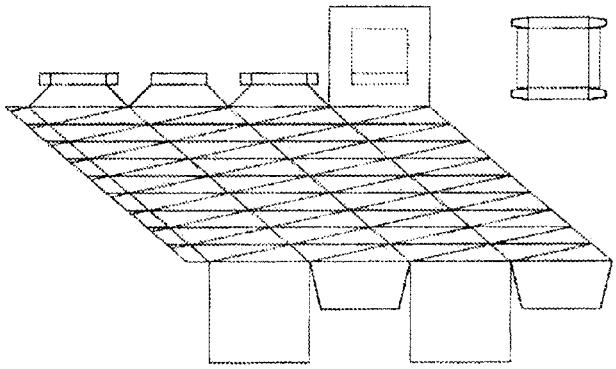

FIG. 26 is a top view of another piece of foldable material having a folding pattern for a box with fluted side walls. The pattern is a composite of a single pattern generated multiple times. The horizontal lines in the tessellation separate the individual pattern pieces. Each piece has eight wall triangles and the required glue tabs. This is generated using a CCS of type (2904). The RCS consists of a one diagonal segment with endpoints selected to so the RED touch and form the triangles. Stacking the pieces in the tessellation, where each RET is a single segment, produces the connecting diagonal line seen in the pattern. The lid in the pattern consists of tabs connected to the wall tessellation forming a square hole with upward protruding collar, and an additional piece that folds into a cap that fits the collar.

Figure 27:
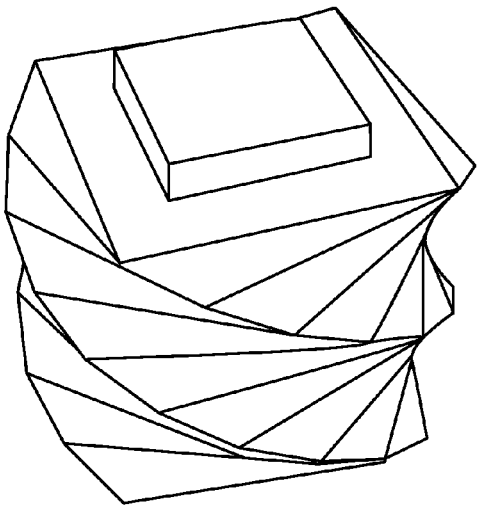

FIG. 27 is a top perspective view of a folded fluted box corresponding to folding pattern of FIG. 26. As the top and bottom perimeter of a folded piece are both congruent squares, the pieces may be stacked. As the top and bottom perimeters are rotated relative to each other, the stacking produces the spiral effect seen in the figure. The cap is placed on the collar.

Figure 28:
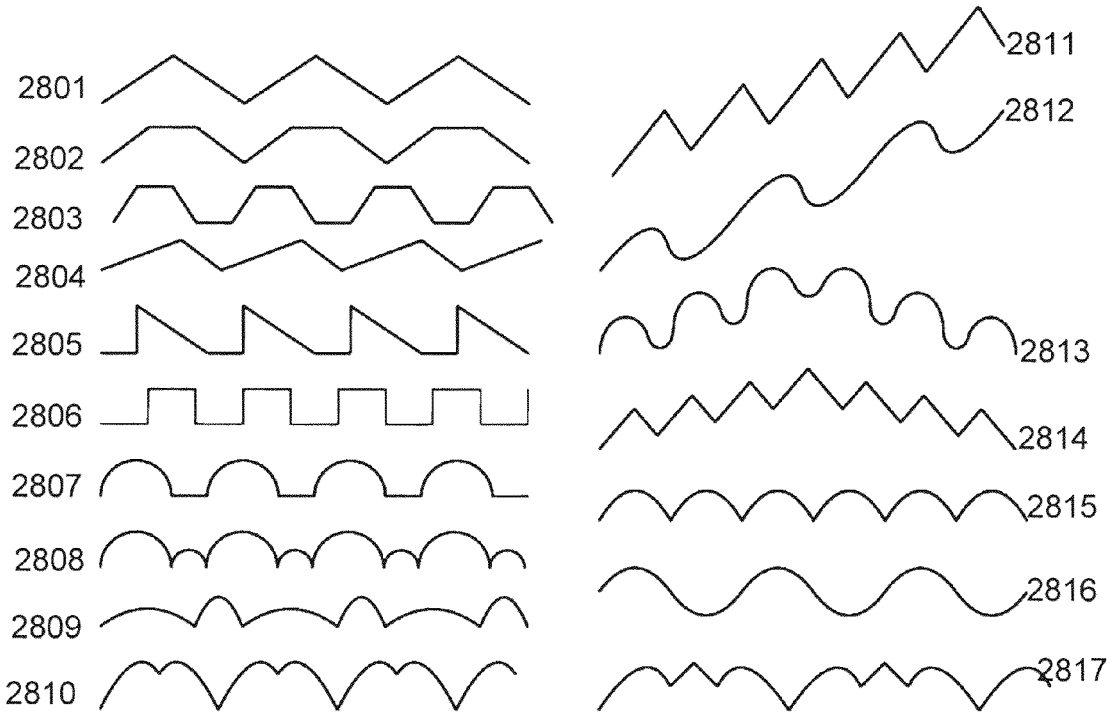

FIG. 28 is a collection of wave patterns suitable for use as RCS data in the Two Cross Section Method and the Strip Map Method for constructing boxes with fluted side walls.

Figure 29:
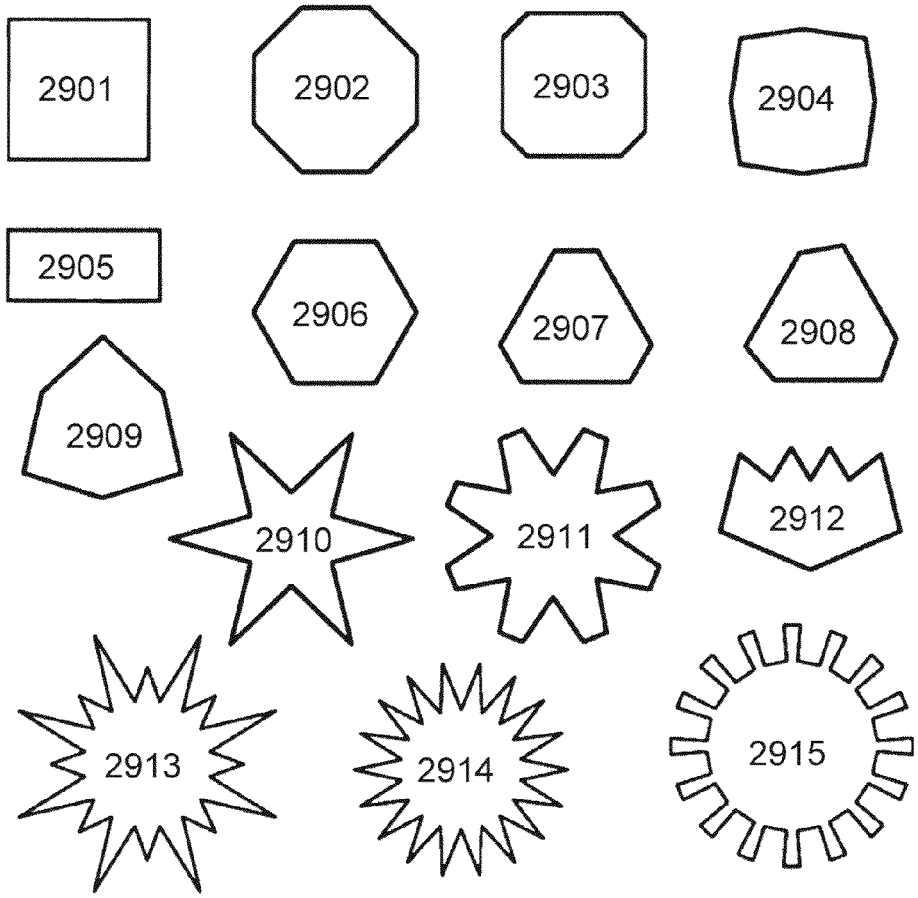

FIG. 29 is a collection of waves available for CCS curves that produce boxes with fluted side walls when used in the Two Cross Section Method or Wave Fold Method with suitable RED or RCS data.

Figure 30:
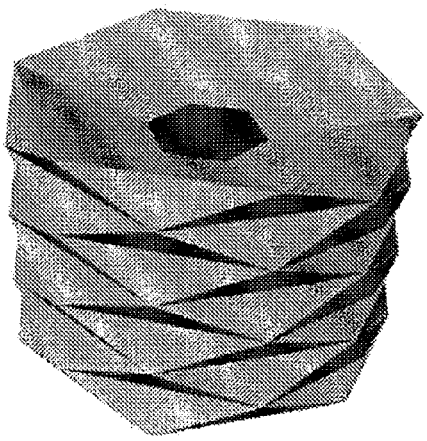

FIG. 30 is a top perspective view of a fluted wall box with a hexagonal lid and floor perimeters.

Figure 31:
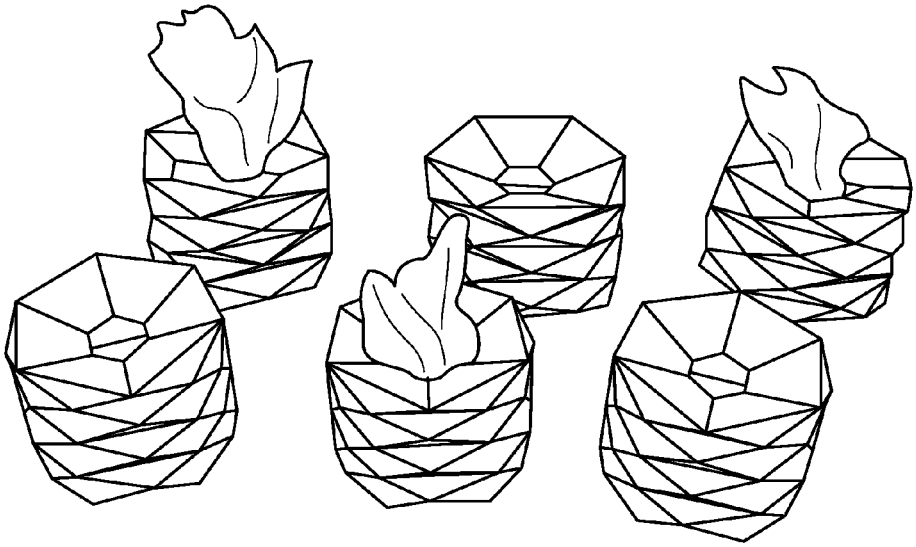

FIG. 31 are top perspective views of six fluted wall boxes, demonstrating a preferred application of dispensing facial tissues.

Figure 32:
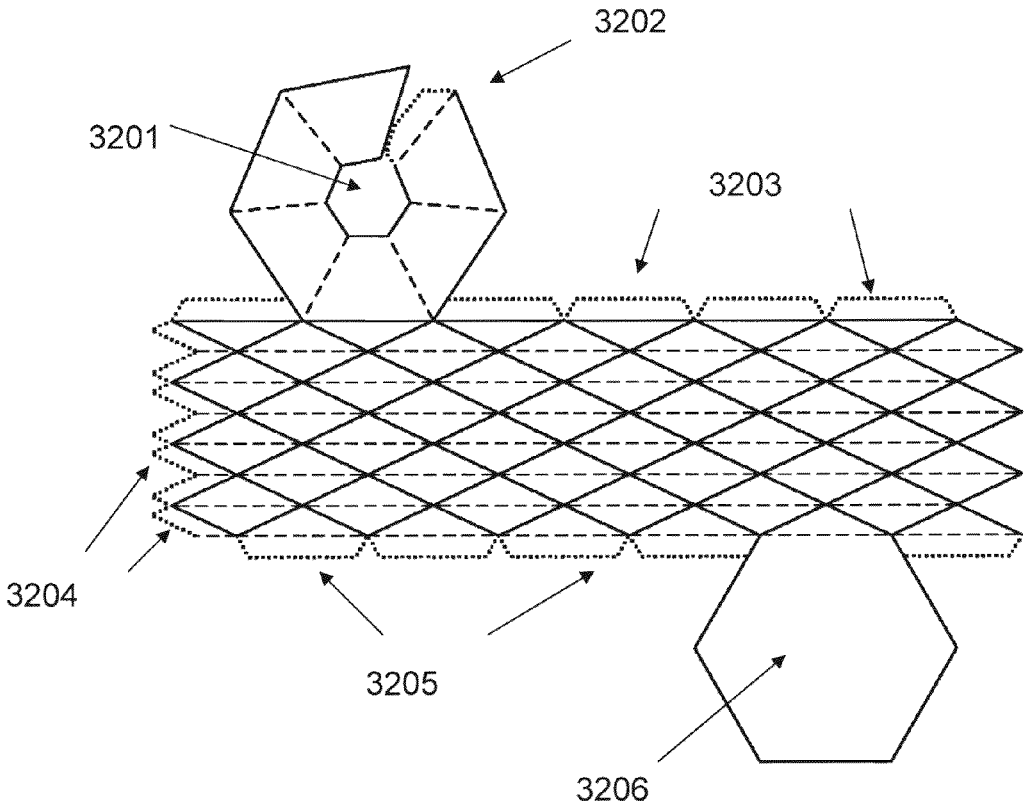

FIG. 32 is a top view of another piece of foldable material having the tessellation folding pattern for the fluted wall boxes of FIG. 31 and FIG. 32. The dashed lines are folded inward, the solid lines are folded outward. The hexagonal dispensing hole (3201) lies below the lid perimeter as assembled in FIG. 32. The flap (3202) is glued to construct the lid, which may then be glued to flaps (3203). The cylinder closing flaps (3204) have been cropped to a few trapezoid regions. The flaps (3205) are glued to the hexagonal base (3206). The solid lines fold outward, the dashed lines fold inward, and the dotted lines are glue tabs.

Figure 33:
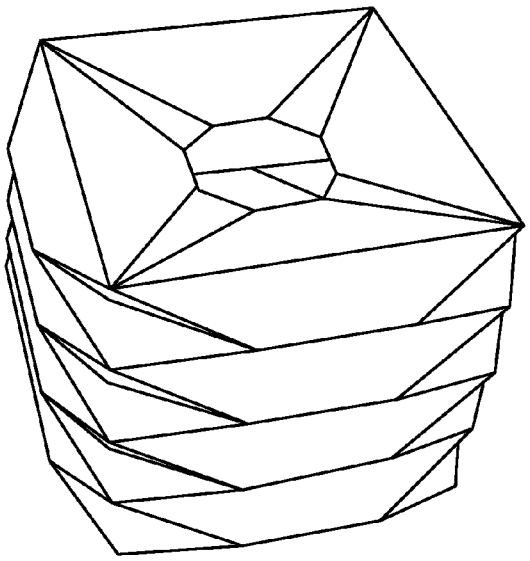

FIG. 33 is a fluted wall box with square lid and floor perimeters. The indented lid has an octagonal dispensing hole. Other lids are available for boxes with removable or opening tops.

Figure 34:
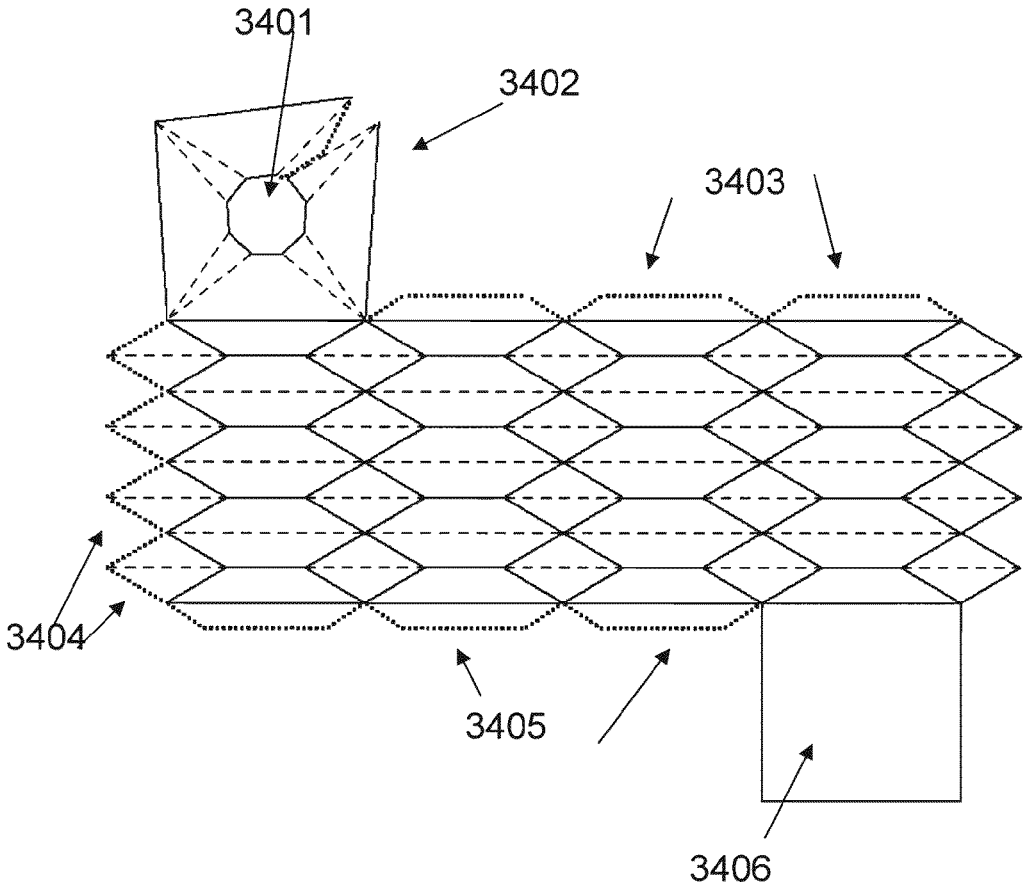

FIG. 34 is the tessellation folding pattern for the fluted wall box of FIG. 32. The octagonal dispensing hole (3401) lies below the lid perimeter as assembled in FIG. 34. The flap (3402) is glued to construct the lid, which may then be glued to flaps (3403). The cylinder closing flaps (3404) show one row of triangle regions that have not been cropped. The flaps (3405) are glued to the square base (3406).

Figure 35:
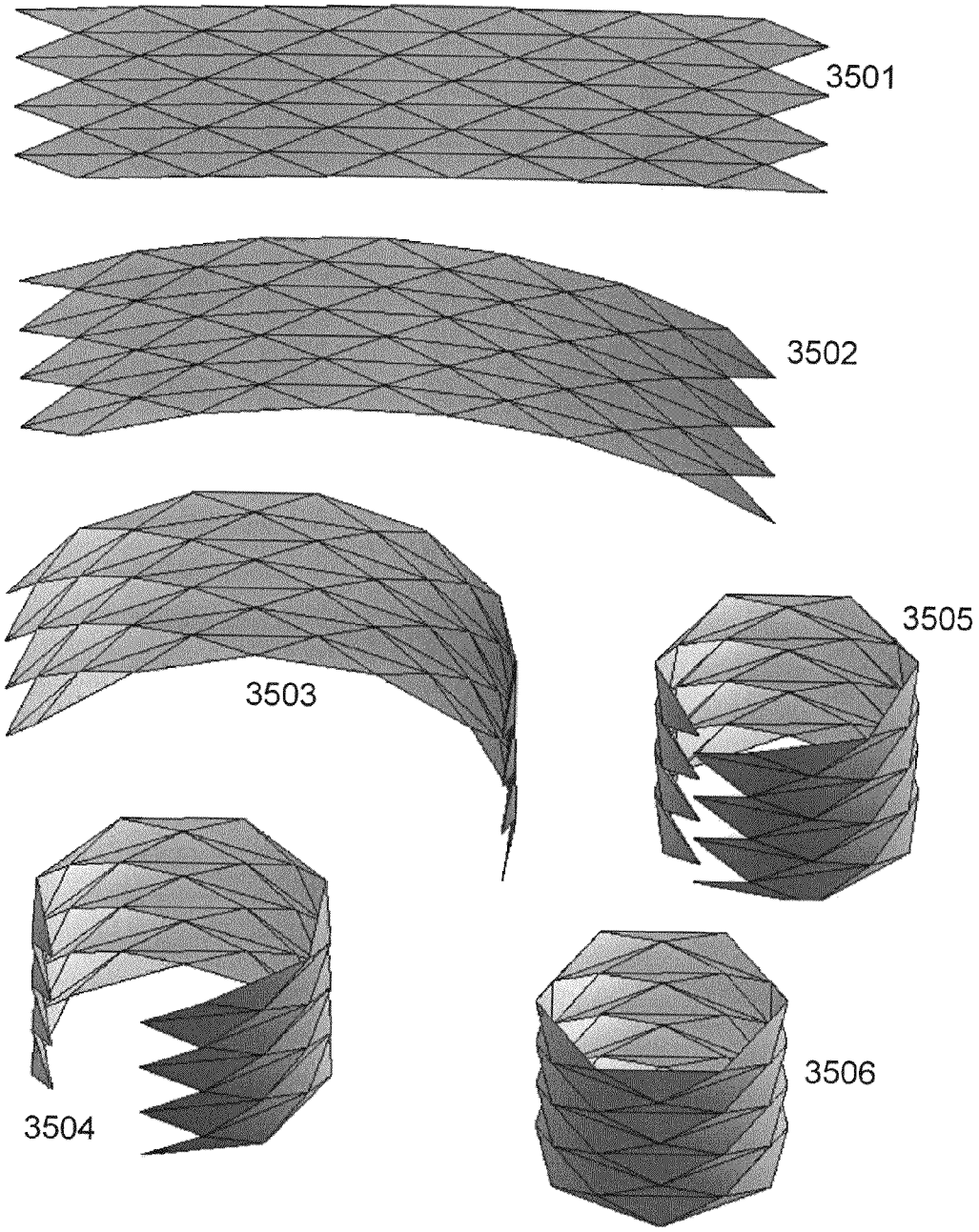

FIG. 35 shows the standard fold process for the box wall of FIG. 30. This can be achieved by an articulating die with the same linkage dynamics as the folding pattern. In a preferred embodiment the die has vacuum holes to hold the material in place while the die folds. The images do not show the glue flap regions, or the lid or floor components. The top of the box recesses towards its middle, to provide strength and dispensing advantages.

Figure 36:
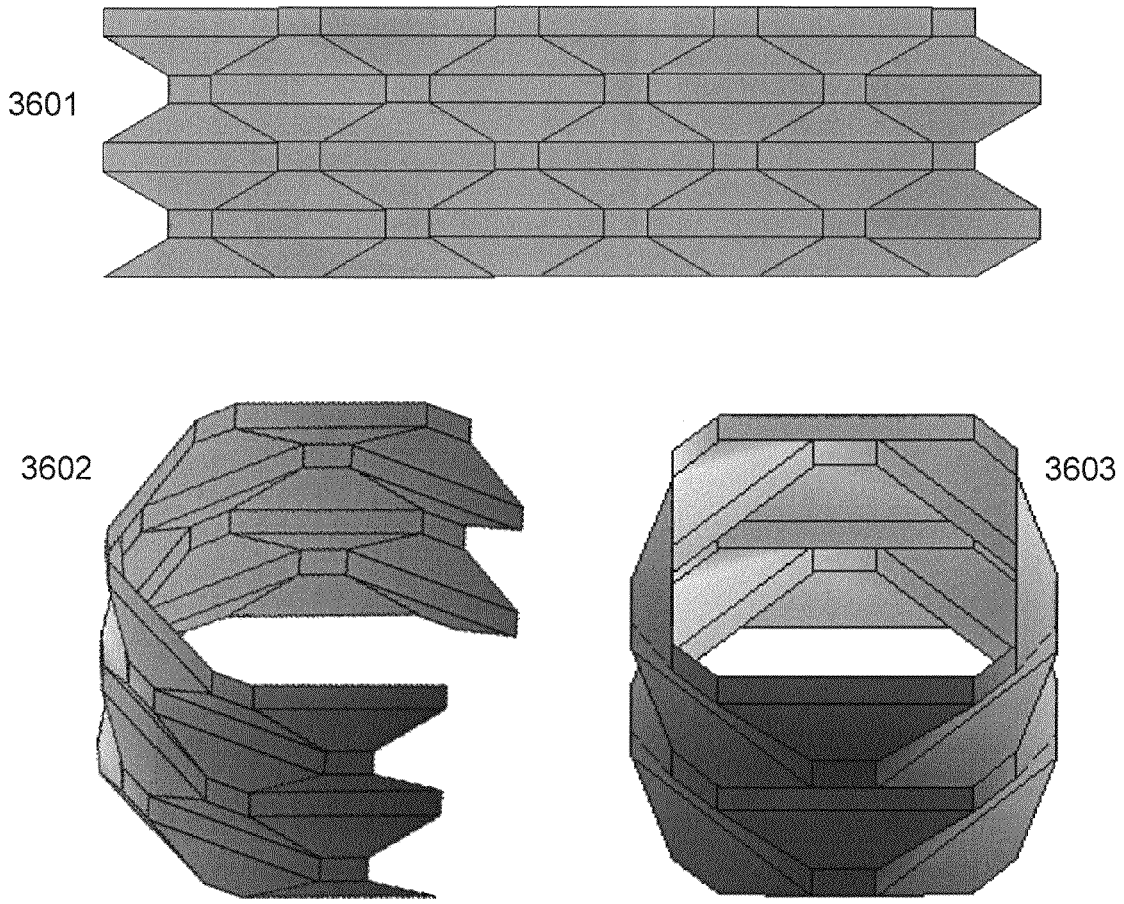

FIG. 36 shows the standard folding process for a box wall geometry using RCS of wave type (2803) and CCS of type (2903). The images do not show the glue flap regions, or the lid or floor components.

Figure 37A:
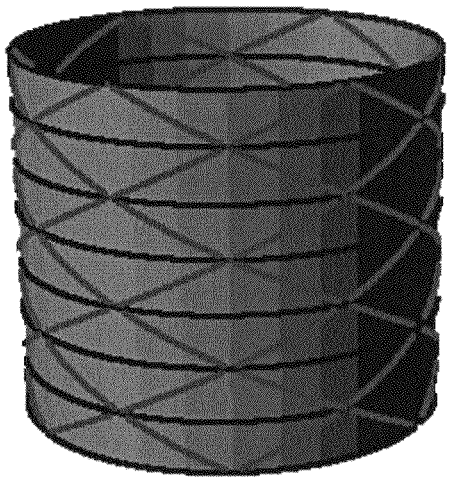
Figure 37B:
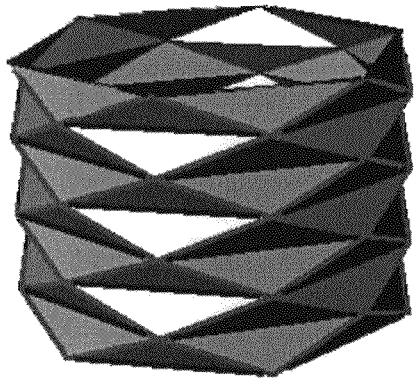

FIG. 37*a* and FIG. 37*b* demonstrate another folding process for making the fluted wall containers. In FIG. 37*a* the fold lines have been pre-etched and a round tube glued closed. A force is applied downward on the top of the box, while the side walls are knocked inward at their inward folding crease lines. The combined effect induces a controlled buckling that results in the fluted structure shown in FIG. 37*b*. The pre-scored diagonal lines form convex creases. The images do not show the glue flap regions, or the lid or floor components, which may be joined to the side walls in the cutout pattern, or as a separate piece before or after the side walls are folded.

Figure 38:
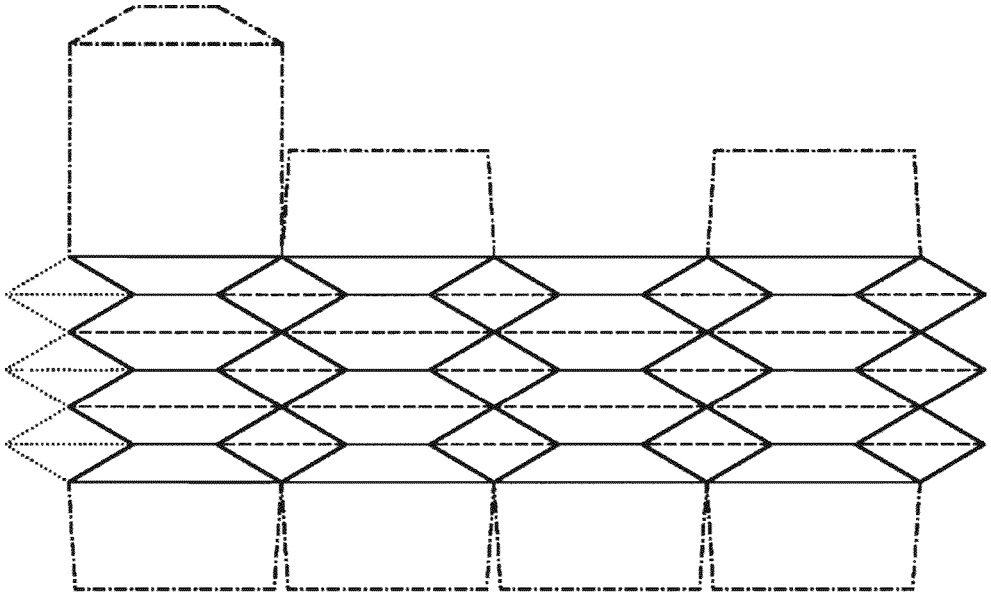

FIG. 38 is a top view of a piece of foldable material having a tessellation folding pattern for a fluted wall box with lid that may be open and closed.

Figure 39:
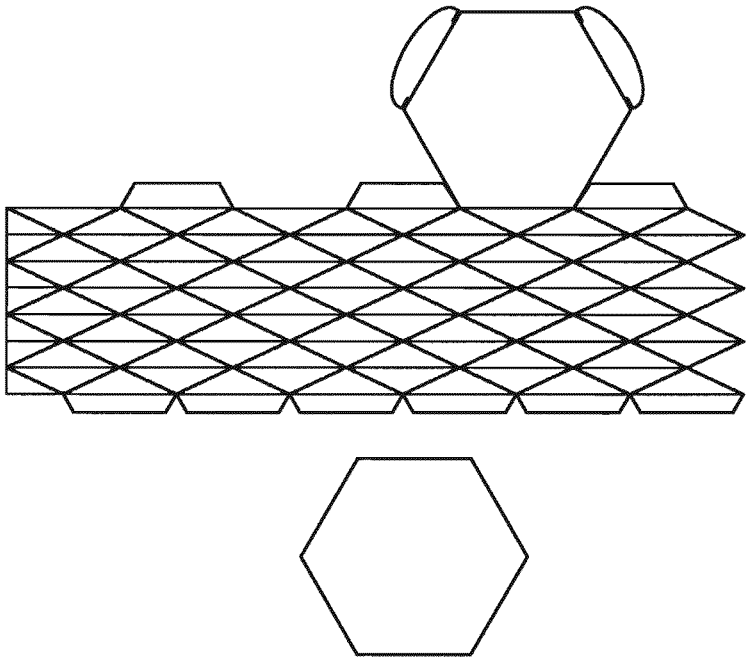

FIG. 39 is a top view of a piece of foldable material having the tessellation folding pattern for a fluted wall box with hexagonal lid that may be open and closed. The lid has two tongues that protrude through the plane of the lid perimeter. The floor is attached as a separate piece.

Figure 40:
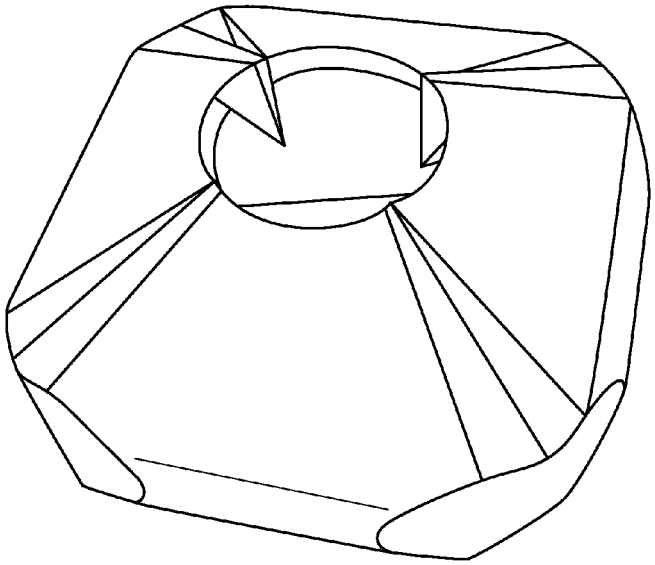

FIG. 40 is a top perspective view of a box with fluted side walls. The lid has a three-dimensional geometry that stands above the lid perimeter. The lid is equipped with pleats enabling the one piece geometry to be folded with no seams along the lid face. Tabs are included to wrap around the pleats and secure them. Alternatively other methods for keeping the pleats bound together are available, including but not limited to glue or staples. The upward slope of the lid toward the center may facilitate the dispensing of materials such as facial tissue.

Figure 41:
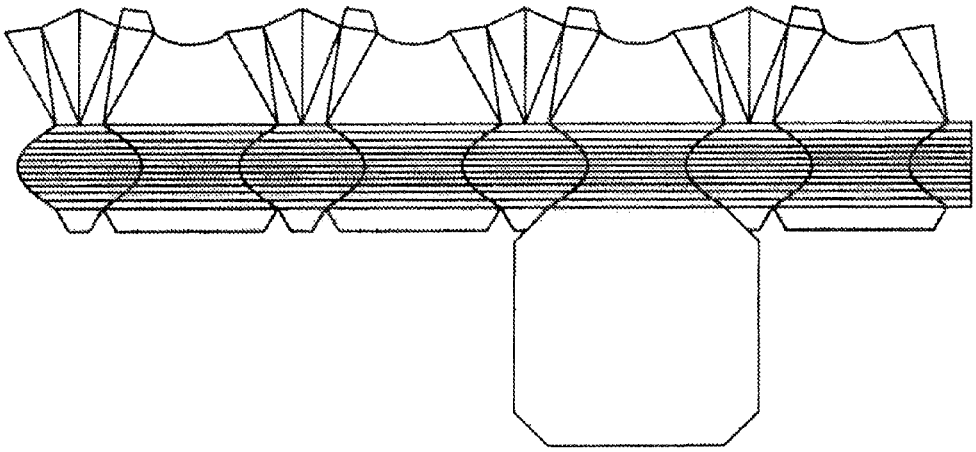

FIG. 41 is a top view of a piece of foldable material having the tessellation pattern that is folded into the image of FIG. 40. The RCS used is a single arch of type similar to (2815). The CCS used is of type (2903).

Figure 42:
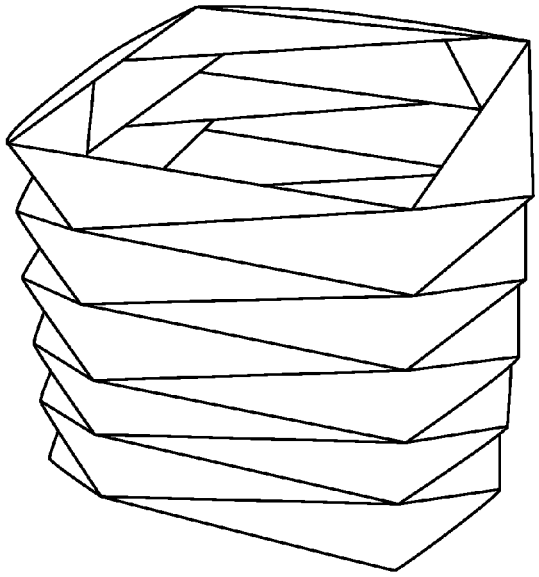

FIG. 42 is a top perspective view of a box with fluted side walls. The lid and floor are omitted from the construction. The RET wave is of type (2801). The CCS wave is of type (2904).

Figure 43:
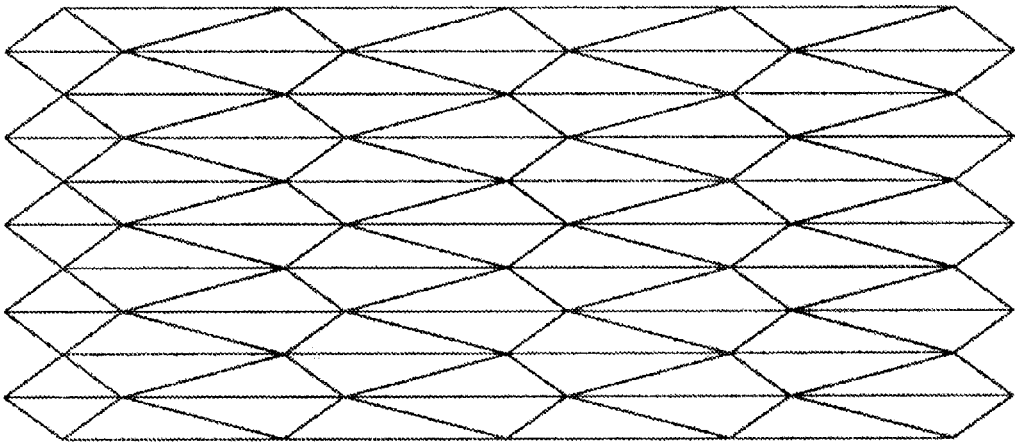

FIG. 43 is a top view of a piece of foldable material having the tessellation pattern that is folded into the image of FIG. 42. The RET wave is of sufficient amplitude to yield triangles in the tessellation. The magnitude of the RET waves alternates between two values in sequential RET positions. The sign of the RET waves also alternates. Since each column of edges forms a square of the same size, the pattern may be segmented into sections along the column edges and then re-assembled. Omitting every other column of facets and re-assembling produces the wall pattern of FIG. 26 and FIG. 27.

DETAILED DESCRIPTION

The inventive concepts are described with reference to the attached figures. The figures are not drawn to scale and they are provided merely to illustrate the instant inventive concepts. Several aspects of the inventive concepts are described below with reference to example applications for illustration. It should be understood that numerous specific details, relationships, and methods are set forth to provide a full understanding of the inventive concepts. One having ordinary skill in the relevant art, however, will readily recognize that the inventive concepts can be practiced without one or more of the specific details or with other methods. In other instances, well-known structures or operation are not shown in detail to avoid obscuring the inventive concepts. The inventive concepts is not limited by the illustrated ordering of acts or events, as some acts may occur in different orders and/or concurrently with other acts or events. Furthermore, not all illustrated acts or events are required to implement a methodology in accordance with the inventive concepts.

The inventive concepts disclosed herein can be applied to the design of multifaceted or fluted sidewall boxes or containers. The boxes may be generally cylindrical or polygonal. The boxes can have a whole in the center of a lid for dispensing items. The lid may be planer, concave, convex, or of more complex geometry. Changing the tab design, which sides of the box the lid and floor are attached to, and other variations will produce a box that is functionally similar. This boxes can be used, for example, for dispensing tissues, string, ribbon, latex gloves, candy and other products, and for receiving objects including business cards, coins, and other items.

The boxes may have a cross-section at certain heights that is a hexagon. Other polygons may be used similarly. The boxes may include circumferential flutes that have, for example, square and octagonal cross sections at various heights.

The inventive methods disclosed herein can be applied to the design of boxes or containers as follows:

1. Determine the desired overall column data (CCS or CSM of the '997 patent) for the box.
2. Adapt the column data to have overlapping ends consistent with the box construction.
3. Select the desired row data (RCS, RED or RET of the '997 patent).
4. Select the desired perimeter geometry for the box lid and box floor.
5. Adapt the row data, relative to column data, to best yield the desired lid and floor perimeter of (4).
6. Generate the folded geometry from (2) and (5)
7. Select a lid pattern with perimeter geometry of (6).
8. Select a floor pattern with perimeter geometry of (6).
9. Back calculate the wall tessellation for (6) from (2) and (5).
10. Trim polygons of (9) designed to overlap in (6) into glue flaps.
11. Attach (7) and (8) to (10) to yield the unfolded box pattern.

The above steps can be performed as follows to design an octagonal box with facets that are primarily triangular surfaces, and square lid and floor offset 45 degrees from each other. This particular application is described for exemplary purposes only. The inventive concepts disclosed herein can be used to design containers having other types of geometries.

To produce a generally octagonal box, the initial choice for CCS is the octagon. As the CCS is used to define a reflection pattern, and it takes two adjacent segments to define a reflection, only the interior vertices of the CCS have this reflection defined. In particular, a polyline (piecewise linear curve, chain of segments) with eight segments has nine vertices, of which two are end vertices. Thus, only the seven interior vertices are locations in the Column Cross-Section Algorithm that generate the RED wave folds. The seven interior vertices have six segments between them. Thus an eight segment CCS may produce a tessellation with only six polygons in the column direction. For repeating planer core materials the reduction by two in the column length does not cause complication. But for box designs that must close to form a connected tube, the missing segments and facets of the generated surface at first pose a problem. To address this problem, the CCS needs to be adapted from a simple sequence of eight segments forming an octagon, to a sequence of ten segments going around the octagon with two extra steps in overlap. This will generate the connected tube with edges that meet exactly or close to exactly. However, in practice this could require the seam of the tube to be taped or glued edge-to-edge. It may be desirable to have an overlap region when the cylinder is closed. Glue may be applied to the overlapping surfaces in the overlap region to prevent the cylinder from unfolding and opening. To provide the overlap region, the CCS may be chosen to have three overlapping segments and in the case of the octagon follow around the octagon to produce a CCS that is eleven segments long. An example of a surface generated with a CCS that had only one overlapping segment is shown in FIG. 11. By using three overlapping segments the resulting tessellation will duplicate one row of facets. The extra row may be used as-is for glue tabs, or may be trimmed as desired to have a smaller overlap region where the tube may be glued surface-to-surface to fasten the tube in a closed configuration. Examples of trimmed glue tabs include item numbers (403), (1202), (1403), (1804), (1901), (2103) in the figures.

Next, the row data is chosen to produce a final pattern with mostly triangular surfaces. Since the chosen CCS is an extended octagon, it has vertex angles all of the same convexity. Thus, the successive RED waves alternate in sign. The waves may be configured to be large enough so that successive waves meet at vertices on the tessellation and thereby produce triangles in the tessellation. In a preferred embodiment, the selected RED wave is the triangle wave, also called the zig-zag wave, that is the wave with segments of common length, common slope magnitude and alternate slope sign. By choosing the amplitude of the RED wave to be sufficiently large (402), and having successive RED waves alternate in sign, the neighboring RED waves may be made to meet and divide the surface into triangles, as seen in FIG. 4. Lessening the amplitudes of the RED waves would yield trapezoids in the tessellation.

The above illustrates how the CCS and RED may be adapted for use in the Wave Fold Method to produce the wall structure for a container with fluted side walls, including the full closed tube, the glue tabs, and controlled floor and lid perimeter geometry.

Figure 1:
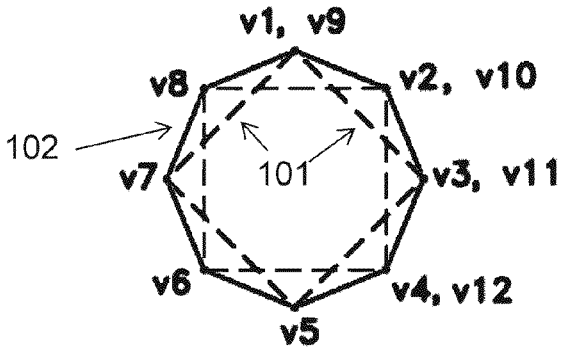
FIG. 1 is a top view of a Column Strip Map (CSM) of a container in the form of a box designed in accordance with the inventive methods disclosed herein. The CSM is depicted in a folded position, with ten triangles each defined by three consecutively label vertices $v_i$, $v_{i+1}$, and $v_{i+2}$. In the folded position as shown, the CSM has a triangle with vertices v1, v2, v3 and a coincident triangle with vertices v9, v10, v11; and a triangle with vertices v2, v3, v4 and a coincident triangle with vertices v10, v11, v12; and the fold edges or lines (102) of the CSM form an octagon.

The Column Strip Map Method may also be adapted and augmented to generate the above-described triangulated box surface. The entry data may be selected with column data in the form of a CSM, and row data in the form of the RCS. The CCS described above may be seen as a reflection scheme in generating the box geometry. By drawing the extended octagonal CCS in the plane, and drawing the reflection line at each vertex, the CCS may be widened into a strip map. To do this, the CCS is offset maximally within the limits of maintaining the same reflection line sequence. The process is shown for a generalized CCS in FIG. 7*a*, and FIG. 7*b*. The reflection lines for the octagonal CCS with three overlaps described above pass through the vertices of the octagon and are normal to the radii of the octagon. Extending these reflection lines until they intersect produces another octagon (102) at 22.5° to the original one. By widening the CCS to the width allowed by these vertices, the CSM may be seen to comprise eight isosceles triangles with sides angled at 22.5°, 22.5°, and 135°, with the original CCS bisecting the congruent sides of the triangles. In FIG. 1 these are the triangles formed by consecutively labeled vertices $v_i$, $v_{i+1}$, and $v_{i+2}$.

To design and incorporate glue tabs using the CSM and Strip Map Method, one or more initial polygons in the strip map are duplicated to their cyclically connecting position at the end of the strip map. This is done in FIG. 2 by duplicating triangle v1, v2, v3 and triangle v2, v3, v4 as triangle v9, v10, v11 and v10, v11, v12, respectively. Then, optionally, the added polygons can be trimmed back to make the glue tab of appropriate size. It may be desirable to cut across the duplicate portion of the strip, still preserving the full set of original polygons, to reduce the duplicated polygons to glue tabs of more manageable size and shape. In some embodiments as is done with (201), the trim line may be parallel to the last edge of the original strip map, and offset into the new duplicated polygon region by the width of the desired glue tabs.

Figure 2:
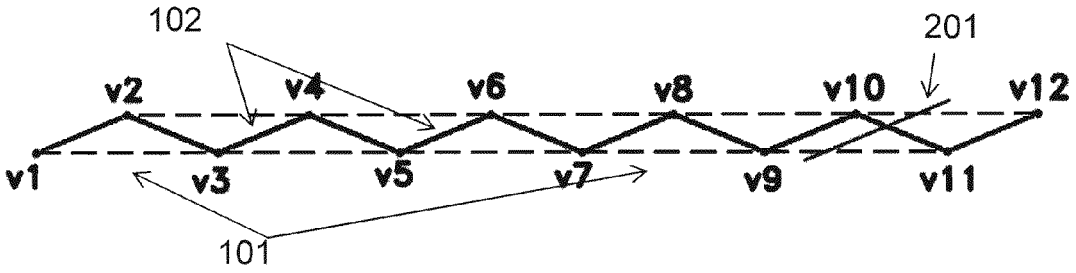
FIG. 2 is a top view of the CSM shown in FIG. 1, in an unfolded position having ten triangles each defined by three consecutively label vertices $v_i$, $v_{i+1}$, and $v_{i+2}$. In the unfolded position as shown, the fold lines (102) of the CSM form a triangular wave pattern. The upper and lower edges of the wave pattern, shown in dashed lines, are parallel. The upper and lower edges are the two squares visible in FIG. 1 when the CSM is folded. The lower edge of FIG. 2 and the corresponding square of the folded CSM depicted in FIG. 1 are denoted by the reference character (101) in FIGS. 1 and 2.

In the unfolded CSM, the triangles connect in sequence to form a strip (FIG. 2). The strip has two parallel sides shown in dashed lines of the figure made from the long legs of the triangles. The short sides of the triangles (102) represent the fold locations in the strip. When folded the strip comprises two squares, shown as dashed lines in FIG. 1, having a common center and at 45 degrees to each other, and their octagonal convex hull. Each square corresponds to one of the sides of the unfolded strip, and the surrounding octagon (102) corresponds to the short sides of the triangles. The original CCS octagon lies midway between the two dashed lines of FIG. 2 on the unfolded CSM.

To produce the triangle faceted surface, the RCS wave may have sufficient amplitude to offset from the CCS to meet the vertices of the CSM. The amplitude of (302) is the combined offset in both directions of the vertices from the center line (301), and should be equal to the width of the unfolded CSM in FIG. 2. When the RCS is positioned over the CSM, with (301) and the plane of (302) perpendicular to (101), the odd vertices of the RCS should be above one side of the unfolded CSM and even vertices above the other side of the unfolded CSM. For the folded CSM, the alternate vertices of the RCS generate column edge chains in the folded pattern that alternately lie directly over the two squares. The squares are dashed lines in FIG. 1.

The lid and floor perimeter may be addressed next. The triangle wave RCS may have first and last segments that end with positive or negative amplitude, or are shortened for an intermediate amplitude. In embodiments with an octagonal floor or lid, the end vertices of the RCS may lie on the wave's center line, midway between maximal and minimal amplitude vertices. This is done where the triangle wave (302) has initial vertex on centerline (301). This may be done by reducing the corresponding first or last segment of the RCS to half length, so that the endpoint vertex would lie over the midline in the unfolded CSM. These end vertices may then generate an octagonal lid or floor perimeter. The floor perimeter generated by the initial endpoint of (302) is (405) on the unfolded pattern and seen as an octagon in the folded FIG. 6. For lid and floor perimeters that are square, the end vertices of the RED or RET may have full amplitude. The final endpoint of (302) has full amplitude and corresponds to (404) and can be seen as the square lid perimeter of FIG. 6. Depending on whether the designer chooses to have the first and last vertices of the RCS lay on the same or different sides of the unfolded CSM, the lid and floor perimeters will be either parallel, or rotated the 45 degrees in relation to each other, respectively. In particular, the lid and floor may be oriented 45 degrees relative to each other if the RCS and RED have an odd number of segments.

The above method illustrates how the CSM and RCS may be adapted for use in the Column Strip Map Method to produce the wall structure for a container with fluted side walls, including the full closed tube, the glue tabs, and controlled floor and lid perimeter geometry.

The column data in the Wave Tessellation Method is the CET. To design boxes with anticipated overall shape using the Wave Tessellation Method may require some experimentation because this methodology produces the tessellation for the folded pattern without first generating the three-dimensional image. In a preferred embodiment the user may generate the three-dimensional image using the Two Cross-Section Method, the Strip Map Method, or the Wave Fold Method, and may then back-calculate the tessellation. The CET may be read from the tessellation. A choice of CET is shown as the dashed line (401). The CET has vertices where it crosses the lines of the tessellation. The CET contains in addition to the spacing distance between these vertices, a factor for each vertex that corresponds to the relative amplitude of the RED crossing through that vertex. Because of the symmetry of this octagon example, the RED (402) shown in broken boldface line, is repeated at each vertex of the CET (401) with the same or opposite sign amplitude.

As the three-dimensional form was cylindrical, i.e. tube-like, the first and last RET waves in the tessellation will be identical. In particular, the first and last vertex of the CET will have RET wave amplitudes that are of the same sign and magnitude. To outfit the tessellation with glue areas for closing the cylinder, a short segment may be added to the CET with new vertex the same magnitude and sign as the previous vertex. This yields an additional RET wave that is parallel to the last one and offset by the length of the segment. The resulting tessellation will have glue tabs of uniform width (403). In cases when the first and second RET waves meet or are less than the offset distance apart, it may be desirable to trim the glue tabs further so that for each value on the row axis, their width does not exceed the distance between the first and second RET waves.

The above methodology illustrates how the CET and RET may be adapted for use in the Wave Tessellation Method to produce the wall structure for a container with fluted side walls, including the full closed tube, the glue tabs, and controlled floor and lid perimeter geometry.

For each of the algorithms disclosed in the '997 patent, the column data must be modified from the expected closed loop data to produce a tessellation pattern that folds into the desired cylindrical form with the required contacts and glue areas. The extended column data may give at least a row of additional polygons, which than can be cropped to smaller size to provide convenient glue tabs conforming to the geometry of the mating wall facets. The row data is also modified to yield the lid and floor perimeters with a chosen geometry. After the general wave pattern of the row is selected, the amplitude of the endpoints of the wave may be altered. This may be done by cropping the first or last portions of the wave, or by attaching other curves to the wave ends. By selecting the final endpoint of correct amplitude, the container structure is provided with the geometry that mates to the desired lid or floor perimeter.

In each of these cases the column data may be adapted to produce a folding pattern with glue tabs extending beyond the closed cylindrical form and conforming to the faceted structure to securely seal the tube closed. Depending on the pattern generation method and the corresponding form of the column data, various geometric components may be translated, reproduced, and trimmed. In preferred embodiments one may translate between the CCS, CET, and CSM by interpolating between the folding algorithms. This enables the column data to be adapted by intermixing the augmentation and trimming principles described above.

Similarly, one may translate between the RET, RED and RCS data by interpolating between the folding algorithms. Based on the choice of the column data, choosing the amplitude of the endpoints of the RCS will produce various lid and floor perimeters. In preferred embodiments the RCS, RED or RET endpoints may be cropped, chosen or extended to generate the desired lid or floor perimeters. In this way the algorithms of the '997 patent may be specialized and further adapted to produce tessellation patterns with glue tabs that close and connect to form cylinder-like, tube-like, box wall and container wall constructions that have specified top and bottom geometries matching desired lid and floor perimeters.

After the box wall design has been determined with flutes, facet geometries, and lid and floor perimeters, the lid or floor pattern can be designed to custom specifications, or can be selected from one that is known in the art. A particular design may be selected based on the requirements of a specific application, whether the floor will be glued, taped, re-opened, or other factors. Some examples of lid and floor options are shown in the figures. For box patterns where the lid or base is attached to the wall system, there may be multiple choices of which side wall to use that result in boxes of equivalent utility. In this case it may be preferred to select the pattern configuration that packs most efficiently on the stock material to reduce waste.

In one embodiment requiring a square base, the leaves/flaps of the floor can be selected to provide a joint-free appearance on the inner and outer side of the box. One way to do this is to have one pair of opposing flaps being rectangles of approximately half the size of the square floor perimeter, and the other pair of opposing flaps being approximately the same size as the perimeter of the square floor. The shorter sides fold in to meet and form the square, with the other two sides covering the inner and outer sides. In this case the floor may be glued together for a three layer thick floor design. This is shown (1803) for a rectangular base and in the floor tabs of FIG. 26 for a square base.

It may be desirable to open and close the top or lid. Several options for a fold-down lid are available, including two shorter side flaps (501) serving as shoulders to support the fold-down lid (502). The fold-down piece may be a square of approximately the same size as the lid perimeter that is attached to one edge of the perimeter with a tongue flap (503) attached to the opposite side of the fold-down piece, so that it tucks in to help the lid remain closed.

After the lid and floor have been designed, the tessellation corresponding to the finalized row and column information may be calculated. This may be done using the wave tessellation method described in the '997 patent. The floor and lid components may then be attached to the tessellation along the corresponding edges. The tessellation, if designed with an extra row of facets for glue regions, may have these facets trimmed to make smaller glue tabs. The folding pattern may be modified according to standard practice to provide small slits near the ends of the lid or floor fold lines to induce folding. Similarly, interference may be reduced by trimming the flaps slightly. The floor tabs (1803) are slightly smaller than the base edges of the tessellation. Other optimization techniques known in the box making art may be employed.

The steps listed above can be varied and/or completed in an order different than the above-described order. In some applications it may be preferred to design the floor and lid first, select the desired row data, and then construct the column data in concordance with the floor, lid, and row constraints. In other applications the floor lid and column data may be chosen first, and then the row data can be selected in concordance with the floor, lid, and column constraints. Similarly the glue tabs for securing the cylinder closed may be added or trimmed at various stages in the process. For example, it may be preferable to add just two segments to the CCS, complete the design steps for the row, floor and lid, examine the tessellation pattern for walls, floor and lid, and then apply the column augmentation step to the CET and tessellation data to design and attach the glue tabs needed to conform to the cylindrical closure.

Once the lid and floor perimeters are determined, a commercially-available lid and floor system that conform to the perimeters can be procured. In some embodiments, flaps may be hinged by fold creases along each of the edges of the lid or floor perimeter. In some embodiments, these flaps when closed may lie generally flat, surface to surface, in approximately the same plane as the lid or floor perimeter. In the same or other embodiments, at least one of the flaps may have the approximate shape of the lid or floor perimeter, and may closely coincide in position to it when in the closed box state. Moreover, in the same or other embodiments, at least one of the flaps can have at least one additional fold edge for a connecting tongue or secondary flap so that in the closed folded state the tongue or secondary flap protrudes through the plane of the floor or lid perimeter to generally conform to the wall geometry. In the same or other embodiments a flap may have a series of additional folded appendages that protrude through the plane of the lid or floor perimeter to subdivide the interior space of the box or container.

In some embodiments, the lid or floor may have a three-dimensional structure that extends above or below the plane of the lid or floor perimeter. This may provide structural advantage to the lid or floor design. For boxes or containers that dispense materials, a lid with three-dimensional structure may be preferred due to its ability to resist the mechanical force of pulling material through the dispensing opening of the lid. For dispensing boxes or containers, a lid with three-dimensional structure may be preferred for its characteristics in funneling the hand to meet the material and/or for funneling the material from the box. For boxes or containers that receive materials through an opening, a lid with three-dimensional structure may be preferred for its characteristics in funneling the hand to meet the material and/or for funneling the material into the box.

The lid or floor may be constructed separately from the wall tessellation pattern, and then attached to the box or container. In this case the lid or floor perimeter should match the lid or floor perimeter provided by the wall geometry. The lid or floor may be attached by gluing, by rolling the lips together, or by other means. The lid or floor may be constructed to form fit the box walls so that it slides on or is easily removable. The lid or floor may be manufactured from the same or similar foldable material as the wall construction, from another type of foldable material, or by a non-folding process. In some embodiments, the box walls may be formed of a paper product, and the lid or floor may be formed from plastic.

In some embodiments, the lid or floor may be constructed from a folding pattern that is incorporated with the wall tessellation pattern on the same sheet of foldable material. The lid or floor portion of the folding pattern may have pleats so that at least two flaps adjoining the wall portion are also connected to each other through the pleats. The use of pleats can simplify assembly, and may offer additional opportunities for three-dimensional structure.

In some embodiments, the two or more wall constructions may be stacked. In this case the lid perimeter of a lower container and the floor perimeter of the container adjacently above should match. Alternatively, the lid and floor may be omitted, and the said adjacent wall portions can be joined or fit together. For stacks with several wall constructions, it may be preferred for only the lowest floor and highest lid to be constructed, with the adjacent wall portions joined to form a single container or box. The joining of stacked wall components may be done in the unfolded sheet to form one tessellation pattern, or may be done after the tubes are closed. One possible advantage of the stacked construction is that it enables multiple CCS waves to be used at various heights of the container, preferably with the corresponding RCS waves chosen to produce mating lid and floor perimeters on adjacent wall portions.

The fluted box or container may be manufactured as follows: Once the folding pattern is determined the pattern is die cut with each of the fold edges receiving an etching, mechanical imprint, stamp, or other mark to induce folding on the marking. The wall section of the pattern may then be then cupped into the generally circular form of the cylinder uniformly, while inducing the folds, with the height of the wall pattern reducing as the folding occurs. As the arc radius of the cupped form reduces, the ends of the pattern may close together to form the cylinder.

The folding machine comprises an articulating die. The die dynamics match the folding parameter of the box wall pattern. This may be achieved by manufacturing the die with plates approximately the same size as the polygons of the pattern, and with hinging between the plates simulating the folding action. Hydraulic, pneumatic, mechanical or other means induce the die to fold along the fold parameter. The die is also outfitted with vacuum holes, so that it may pick the precut sheet up and hold the marked polygons consistently in position against the corresponding polygons of the die. Once the material is secured to the die by the vacuum, the die is articulated with its prescribed dynamics. This causes the sheet to fold with it, and folding occurs along the markings of the sheet pattern. In a preferred embodiment the articulating die may fold the side wall portion of the box, and then convention box/container forming machinery used to fold and glue the remaining steps as needed. In another preferred embodiment the articulating die forms all folds in pattern, with sequenced folding of the box side walls, floor, and lid as needed. Tabs or other methods may then be used to fasten the box wall ends together to make a cylindrical of other form.

A collection of wave patterns is shown in FIG. 28. The wave patterns are suitable for use as RCS data in the Two Cross Section Method and the Strip Map Method for constructing boxes with fluted side walls. Waves (2801)-(2804) and waves (2808)-(2817) are also suitable for RET and RED data used in the Wave Tessellation Method and Wave Fold Method. Other wave patterns can be readily designed by persons skilled in the art of box making. For each wave depicted in FIG. 28, the row axis for the wave is preferred to run horizontally through it. This may be placed on the centerline of a wave pattern or above or below the centerline for various effects relative to the choice of column data. Waves (2811) and (2812) migrate away from the horizontal line. In some embodiments it may be preferred to select an axis for a wave that similarly migrates away from the wave.

Each of the waves has a general structure that is recognizable by those skilled in the art of box making. Wave (2801) is the triangle wave used in (302) and many other of the examples. Wave (2804) is similar but with line segments having slopes of distinct absolute value. Wave (2803) has segments of zero slope. The segments with non-zero slope have the same slope absolute value. A variation is possible with non-zero slopes resembling (2804). Wave (2806) is often called the square wave, and has horizontal and vertical segments whose lengths are selected as a parameter in various applications. Wave (2807) has for defining components a half-circle and horizontal line segment. A variation on (2807) uses a parabolic arch or other arch type in substitution for the half circle. Wave (2810) has vertices between arched components. The two endpoints of each of these arched components lie on distinct horizontal lines. The arched components of (2810) are also connected in alternating minor image. Wave (2817) combines both arched components and line segments.

The waves shown in FIG. 28 can be decomposed into their components, including vertices, segments, convex smoothly arched curves, and concave smoothly arched curves. These components have attributes, such as slope, length, curvature, angle of inclination, and symmetry. In preferred embodiments the RED, RET, and/or RCS may be selected from the waves of FIG. 28 by cropping them or extending them, or by constructing a new wave from the components of the waves shown. In other embodiments components not shown may also be included in the construction. It is preferred that the constructed wave have no undercuts. For the RED and RET data it is further preferred that the constructed wave have no vertical slopes.

In FIG. 29 a collection of waves available for CCS curves is shown that produce boxes with fluted side walls when used in the Two Cross Section Method or Wave Fold Method with suitable RED or RCS data. In the images shown it is preferred that the curve overlaps itself on at least two edges to produce the polygons needed to form the closed cylinder and glue tabs. Other polygons with similar or distinct symmetry can be generated for use as the CCS by those trained in the art. It is preferred that the polygon not have self-crossings, as found for example in the numeral 8. The CCS may be widened to yield a folded CSM for use in the Strip Map Method or Composition of Local Isometries Method of '997 patent. The CCS augmented from the polygons shown in FIG. 29 have attributes including segments of given length, angle formed at a vertex by the two adjacent segments, and convexity of the vertex. Waves (2910)-(2915) have vertices of both convexities. The star geometries of waves (2910), (2911), (2913), (2915) and other waves can be adapted to similar waves with other symmetries and number of star points.

In embodiments where the box is used for dispensing facial tissues it may be desirable to coil the tissues on a roll, so that the dispensed tissues are drawn from the inside of the roll. It may be desirable to use z-folding on a sequential chain or string of tissues, and then to roll the z-folded condensed material onto the coil. This enables the tissues to dispense from the box without entangling or excessively twisting. The z-folding and/or a light connection method may be used so that dispensing one tissue causes the next one to pull out far enough that it is conveniently accessible for the next time. For string and other materials it may also be desirable to have the material unwound from the center of a ball or winding.

I claim:

1. A method for designing and manufacturing a container, comprising:

determining a desired overall column data for the container in the form of column edge tessellation (CET) data, column cross section (CCS) data, and column strip map (CSM) data;

adapting the column data to have overlapping ends, wherein adapting the column data to have overlapping ends comprises translating between the CET data, the CCS data, and the CSM data;

selecting desired row data in the form of row edge tessellation (RET) data, row cross section (RCS) data, and row edge DPF (RED) data;

selecting a desired perimeter geometry for a lid and floor of the container;

adapting the row data, relative to the column data, to yield the desired lid and floor perimeter geometries, wherein adapting the row data, relative to the column data, to yield the desired lid and floor perimeter geometries comprises translating between the RET data, the RCS data, and the RED data;

generating a folded geometry for the container;

selecting a floor pattern based on the floor perimeter geometry;

back calculating a wall tessellation;

trimming polygons to overlap in into glue flaps; and attaching the overlapping polygons to yield an unfolded box pattern.

2. The method of claim 1, wherein translating between the CET data, the CCS data, and the CSM data comprises interpolating between folding algorithms.

3. The method of claim 1, wherein translating between the RET data, the RCS data, and the RED data comprises interpolating between folding algorithms.

* * * * *